US011654076B2

(12) United States Patent
Cross et al.

(10) Patent No.: US 11,654,076 B2
(45) Date of Patent: May 23, 2023

(54) BODY MASSAGING APPARATUS

(71) Applicant: RANGE OF MOTION PRODUCTS, LLC, Rancho Santa Fe, CA (US)

(72) Inventors: Terry Cross, Blue Hill, ME (US); Nicolas Bartolotta, Venice, CA (US)

(73) Assignee: RANGE OF MOTION PRODUCTS, LLC, Rancho Santa Fe, CA (US)

( * ) Notice: Subject to any disclaimer, the term of this patent is extended or adjusted under 35 U.S.C. 154(b) by 530 days.

(21) Appl. No.: 15/982,956

(22) Filed: May 17, 2018

(65) Prior Publication Data

US 2018/0280229 A1 Oct. 4, 2018

Related U.S. Application Data

(63) Continuation of application No. 15/095,010, filed on Apr. 8, 2016.

(Continued)

(51) Int. Cl.
*A61H 15/00* (2006.01)
*A61H 7/00* (2006.01)

(52) U.S. Cl.
CPC ..... *A61H 15/0092* (2013.01); *A61H 7/003* (2013.01); *A61H 2015/005* (2013.01);
(Continued)

(58) Field of Classification Search
CPC .... A61H 7/003; A61H 15/00; A61H 15/0092; A61H 2015/0014; A61H 2015/0007;
(Continued)

(56) References Cited

U.S. PATENT DOCUMENTS 5,318,058 A * 6/1994 Zimmerman ..... A61H 3/02 135/68
5,402,587 A * 4/1995 Buschbacher ..... A61H 3/00 135/67

(Continued)

FOREIGN PATENT DOCUMENTS

WO 2013/070632 A1 5/2013

OTHER PUBLICATIONS

"ARMAID", copyright 2019 by The Armaid Company, Inc., retrieved from the internet, https://amnaid.com/, on Jun. 3, 2019.

(Continued)

*Primary Examiner* — Colin W Stuart
*Assistant Examiner* — Matthew D Ziegler
(74) *Attorney, Agent, or Firm* — Heidi Eisenhut; Loza & Loza, LLP

(57) ABSTRACT

A self-operated, or therapist assisted, apparatus particularly adapted for massaging a user's body parts affected by repetitive strain injuries such as tendinitis and carpal tunnel syndrome, comprises two clamping arms joined at a base end and provided with an opening at the other end. Flexible massaging members are mounted on opposite medial sections of the arms. A body part may be placed between the two arms of the device to be acted upon by the massaging members, whereby the body part is adjustably clamped between the pair of massaging members and massaged by translating and rotating movements of the body part along an axis perpendicular to the mounting axes of the massaging members. Alternatively, one of the arms of the apparatus may be separated from the apparatus and used independently to massage body parts that otherwise would not fit between the arms of the apparatus.

14 Claims, 24 Drawing Sheets

Related U.S. Application Data

(60) Provisional application No. 62/195,136, filed on Jul. 21, 2015, provisional application No. 62/144,714, filed on Apr. 8, 2015.

(52) U.S. Cl.
CPC ..... *A61H 2015/0014* (2013.01); *A61H 2201/0192* (2013.01); *A61H 2201/1253* (2013.01); *A61H 2201/164* (2013.01); *A61H 2201/1635* (2013.01); *A61H 2201/1676* (2013.01); *A61H 2205/06* (2013.01); *A61H 2205/10* (2013.01)

(58) Field of Classification Search
CPC ..... A61H 2015/0042; A61H 2015/005; A61H 2015/0057; A61H 2201/0192; A61H 2201/1253; A61H 2201/16; A61H 2201/1602; A61H 2201/1635; A61H 2201/1638; A61H 2201/164; A61H 2201/1676; A61H 2205/06; A61H 2205/10; A61H 2205/102; A61H 2205/12
See application file for complete search history.

(56) References Cited

U.S. PATENT DOCUMENTS

| | | | | |
|---|---|---|---|---|
| 5,730,708 | A | 3/1998 | Spratt | |
| 5,792,081 | A | 8/1998 | Cross | |
| 5,885,232 | A * | 3/1999 | Guitay | A61H 7/008 601/6 |
| 6,010,468 | A * | 1/2000 | Grove | A61H 1/0266 601/23 |
| 6,436,062 | B1 * | 8/2002 | Iwamoto | A61H 15/00 601/122 |
| 10,004,658 | B2 * | 6/2018 | Marty | A61H 15/02 |
| 2008/0086066 | A1 * | 4/2008 | Munday | A61H 39/04 601/135 |
| 2011/0137218 | A1 | 6/2011 | Collins | |
| 2013/0289454 | A1 | 10/2013 | Wang et al. | |
| 2014/0039363 | A1 | 2/2014 | Johnston | |

OTHER PUBLICATIONS

EP Appln. No. 16777453.8. Extended EP Search Report (dated Oct. 1, 2018).
International Search Report & Written Opinion for PCT/US16/26836 dated Aug. 18, 2016; 6 pages.

* cited by examiner

BODY MASSAGING APPARATUS

CROSS REFERENCE TO RELATED APPLICATIONS

This application is a Continuation-in-Part of U.S. patent application Ser. No. 15/095,010 filed Apr. 8, 2016, which claims priority to a provisional application, U.S. Ser. No. 62/144,714, filed Apr. 8, 2015, entitled Limb Massager, by Terry Cross, which is hereby incorporated by reference. This application further claims priority to a provisional application, U.S. Ser. No. 62/195,136, filed Jul. 21, 2015, entitled Limb Massager, by Terry Cross, which is hereby incorporated by reference.

FIELD

The present disclosure relates to self-operated massaging devices and therapist facilitated and more particularly multi-functional full body massager apparatus having a plurality of components which may be separated and used independently of the full body massager apparatus as a whole.

BACKGROUND

In the field of physical therapy self-operated body and therapist facilitated massaging devices have been known to be adapted for the treatment of wrists and arms affected by carpal tunnel syndrome, tendonitis and repetitive strain and overuse injuries and for the treatment of muscular and connective tissue anomalies of the neck, shoulder girdle, elbows, hips, knees, thighs, calves, ankles, feet, toes and fingers.

However, most self-operated and therapist facilitated massaging devices are hand-held massagers that do not provide for any stabilizing support to create a counterforce and therefore cannot apply any substantial amount of controllable therapeutic pressure on the ailing muscle, tendon, or joint. As it relates to self-use and facilitated use, other automatic massaging devices driven by electric motors are not capable of reacting to a sudden pain felt by the user, and, therefore can inflict a great deal of unnecessary suffering before the user or therapist can turn off the device as the massaging heads reach a particular sensitive spot. Other manual massage devices are set at specific points and do not have the capability for the user or therapist to adjust pressure in real time There is therefore a need for a simple and inexpensive, yet effective self-operated (or hand-operated) full body trigger point and active muscle release massaging apparatus which can be firmly stabilized (creating significant counterforce) and applied under the user's or therapist's own motions without risk of inflicting undue pain or discomfort and offers unlimited control of all vectors, angles and pressure in order for the user to be in constant and immediate control for the user to change any variables easily.

Therapeutic massage that emphasizes targeting trigger points and or an active release of muscle tension requires the unique stabilized compressive counterforce offered by this device. Until now, there has been now efficient and effective way for compressive counterforce to be achieved on all limbs and areas of the body. The device described herein employees a biomechanically and ergonomically novel design that provides self-users and facilitated users the ability to perform therapeutic techniques that previously required substantial professional therapeutic training or were not possible to do immediately.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a body massaging apparatus is provided. The body massaging apparatus comprises a first arm, having a first arm upper end and a first arm lower end, the first arm lower end having a pair of elongated members extending outward therefrom and separated by a channel, each of the elongated members in the pair of elongated members having a slotted guideway; a second arm having a second arm upper end and a second arm lower end, the second arm lower end having a securing member adapted to be received in a pair of depressions formed in the slotted guideway of the each of the elongated members in the pair of elongated members, where the second arm is rotatable and removeable in relation to the first arm; a first massaging member having a pair of moveable rollers secured within a medial section of the first arm by an upper plate member and a lower plate member; and a second massaging member secured within a medial section of the second arm.

According to one aspect, the upper plate member comprises a first surface and an opposing second surface; a first side portion; a second side portion; a medial portion integrally connected to the first and second side portions; a first stopper located on the upper surface of the first side portion; and a second stopper located on the upper surface of the second side portion.

According to another aspect, the upper plate member further comprises a first opening extending through the first side portion and the first stopper; and a second opening extending through the second side portion and the second stopper.

According to yet another aspect, the upper plate member further comprises a rigid shaft extending perpendicularly outward from the medial portion into an aperture in the first arm; a first roller shaft extending from a first roller in the pair of moveable roller into the first opening; and a second roller shaft extending from a second roller in the pair of moveable rollers in the second opening.

According to yet another aspect, the diameter of the rigid shaft is smaller than the diameter of the aperture allowing the rigid shaft to move within the aperture.

According to yet another aspect, the diameter of the first roller shaft is smaller than the diameter of the first opening allowing the first roller shaft to move within the first opening; and wherein the diameter of the second roller shaft is smaller than the diameter of the second opening allowing the second roller shaft to move within the second opening.

According to yet another aspect, the upper plate member has an angle of rotation of 25 degrees in a single direction.

According to yet another aspect, the upper plate member has an angle of rotation of 7 degrees in a single direction.

According to yet another aspect, the lower plate member comprises a first surface and an opposing second surface; a first side portion; a second side portion; a medial portion integrally connected to the first and second side portions; a first stopper located on the upper surface of the first side portion; and a second stopper located on the upper surface of the second side portion.

According to yet another aspect, the lower plate member further comprises a first opening extending through the first side portion and the first stopper; and a second opening extending through the second side portion and the second stopper.

According to yet another aspect, wherein the lower plate member further comprises a rigid shaft extending perpendicularly outward from the medial portion into an aperture in the first arm; a first roller shaft extending from a first roller in the pair of moveable roller into the first opening; and a second roller shaft extending from a second roller in the pair of moveable rollers in the second opening.

According to yet another aspect, wherein the diameter of the rigid shaft is smaller than the diameter of the aperture allowing the rigid shaft to move within the aperture.

According to yet another aspect, wherein the diameter of the first roller shaft is smaller than the diameter of the first opening allowing the first roller shaft to move within the first opening; and wherein the diameter of the second roller shaft is smaller than the diameter of the second opening allowing the second roller shaft to move within the second opening.

According to yet another aspect, the apparatus further comprising a base connected to bottom surfaces of the elongated members of the first arm.

According to yet another aspect, wherein the first arm comprises an outer surface; an inner surface having a first cavity adapted to receive the first massaging member; and an inner wall integrally connected between the outer and inner surfaces.

According to yet another aspect, wherein the outer surface has an arcuate shape and the inner surface comprises an upper portion; a lower portion; and a medial portion integrally connected between the upper portion and the lower portion by an upper edge portion and a lower edge portion, the upper and lower edge portions extend perpendicularly outward from the medial portion forming the first cavity; and wherein the upper portion and the lower portion are located within a first vertical plane and the medial portion is located within a second vertical plane, where the first vertical plane is different than the second vertical plane.

According to yet another aspect, wherein the second arm comprises an outer surface; an inner surface having a second cavity adapted to receive the second massaging member; and an inner wall integrally connected between the outer and inner surfaces; and wherein the outer surface has an arcuate shape and the inner surface comprises an upper portion; a lower portion; and a medial portion integrally connected between the upper portion and the lower portion by an upper edge portion and a lower edge portion, the upper and lower edge portions extend perpendicularly outward from the medial portion forming the second cavity.

According to yet another aspect, the upper portion and the lower portion are located within a first vertical plane and the medial portion is located within a second vertical plane, where the first vertical plane is different than the second vertical plane.

According to yet another aspect, the apparatus further comprises a first handle connected to, and extending perpendicularly outward from the first arm upper end; and a second handle connected to, and extending perpendicularly outward from the second arm upper end.

According to yet another aspect, wherein the first and second arms and the first and second massaging members are shaped and dimensioned to adjustably retain a human body part between the first massaging member and the second massaging member when the first arm upper end and the second upper arm end are and held in close proximity to each other, whereby pressure that is applied to the human body part is variable and dynamically leveraged as the human body part is moved between the first and second arms relative thereto.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1:
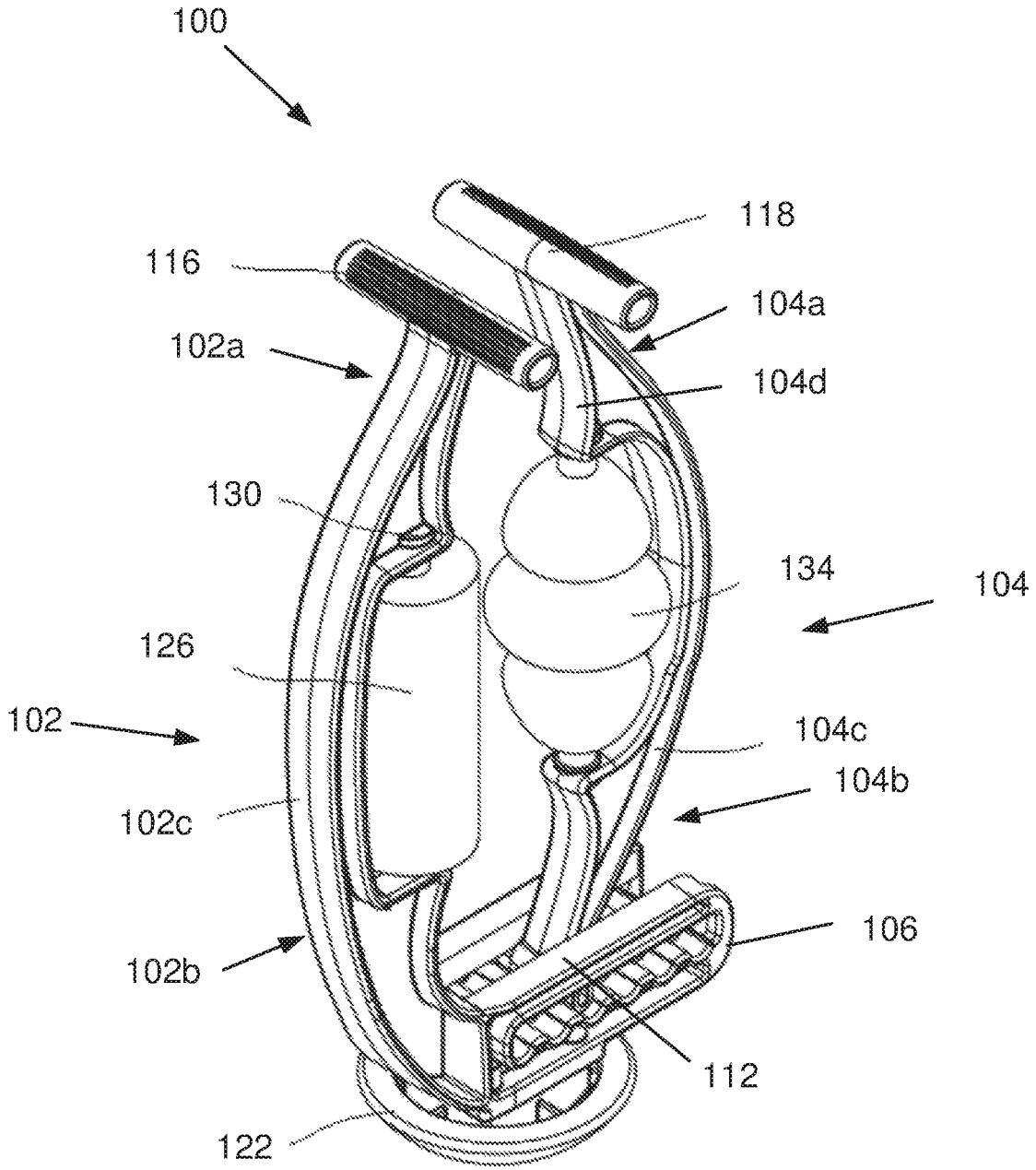
FIG. 1 is a side perspective view of a body massaging apparatus, according to one aspect.

In the following description, specific details are given to provide a thorough understanding of the embodiments. However, it will be understood by one of ordinary skill in the art that the embodiments may be practiced without these specific details.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage, or mode of operation.

Overview

Embodiments of the present disclosure are directed to a multi-functional full body massaging apparatus. The multi-functional full body massaging apparatus may also be referred to as a multi-functional full body trigger point and active muscle release massaging apparatus. The multi-functional body massager apparatus is a hand-operated, body-massaging apparatus for the preventive or remedial treatment of muscular, connective tissue, and joint disorders and more specifically for the treatment of repetitive strain injuries and overuse injuries such as carpal tunnel syndrome, elbow tendinitis, knee tendinitis, Achilles tendinitis, general joint arthritis and the like. The apparatus is in the form of a simple, yet efficient device that allows for stable and easily controllable application of rolling pressure to the affected area.

These and other valuable objects are achieved by a self-operated or facilitated apparatus full body massaging apparatus comprising two arms (for example clamping arms) removably joined about a base, which can be placed on any surface and positioned to any desired orientation, and provided with an opening at the other end. The arms are adjustable relative to each other, providing for use with varying sized body parts. Massaging members installed in a face-to-face arrangement in medial sections of the arms can be brought to work against body parts while the free upper ends of the arms are held together with the free hand of a user. The apparatus may be adapted for massaging body parts of a user affected by repetitive strain injuries and joint conditions, including but not limited to tendinitis, carpal tunnel syndrome, and arthritis. Flexible massaging members may be mounted on or secured within opposite medial sections of the arms. A body part may be placed between the two arms of the device to be acted upon by the massaging members, whereby the body part is adjustably clamped (via stabilized counterforce) between the pair of massaging members and massaged by translating and rotating movements of the body part along an axis perpendicular to the mounting axes of the massaging members.

Alternatively, the free upper ends of the arms may be held in close proximity to each other by a tensioning component or toggle, with or without the assistance of the free hand of the user. The apparatus may compress (via stabilized counterforce) the body part from opposite sides to enhance blood and lymph circulation through muscle tissue, connective tissue, and joints. The relaxing effect on connective tissue and strengthening effect of active muscle release allows for a greater range of muscular motion and optimized muscular function. Moreover, the apparatus furthers the increase of the range of motion (ROM) of muscles subjected to massage, so tight muscles do not incessantly pull on the boney attachment across specific joints where they are attached through tendons. Increasing the muscle ROM reduces the muscles pulling at their tendons wherever they are attached. The apparatus has been designed for the user to apply several techniques including, but not limited to, Active Release/Trigger Point Therapy and Cross Fiber Friction and Myofascial Release Technique, all to specifically increase ROM, neuromuscular re-education and joint function.

Alternatively, one of the arms of the apparatus may be separated from the apparatus and used independently to massage body parts that otherwise would not fit between the arms of the apparatus. Additionally, the massaging members may be separated from the arms in which they are secured and used independently to massage body parts that otherwise would not be reachable when attached to an arm.

Body Massaging Apparatus

Figure 2:
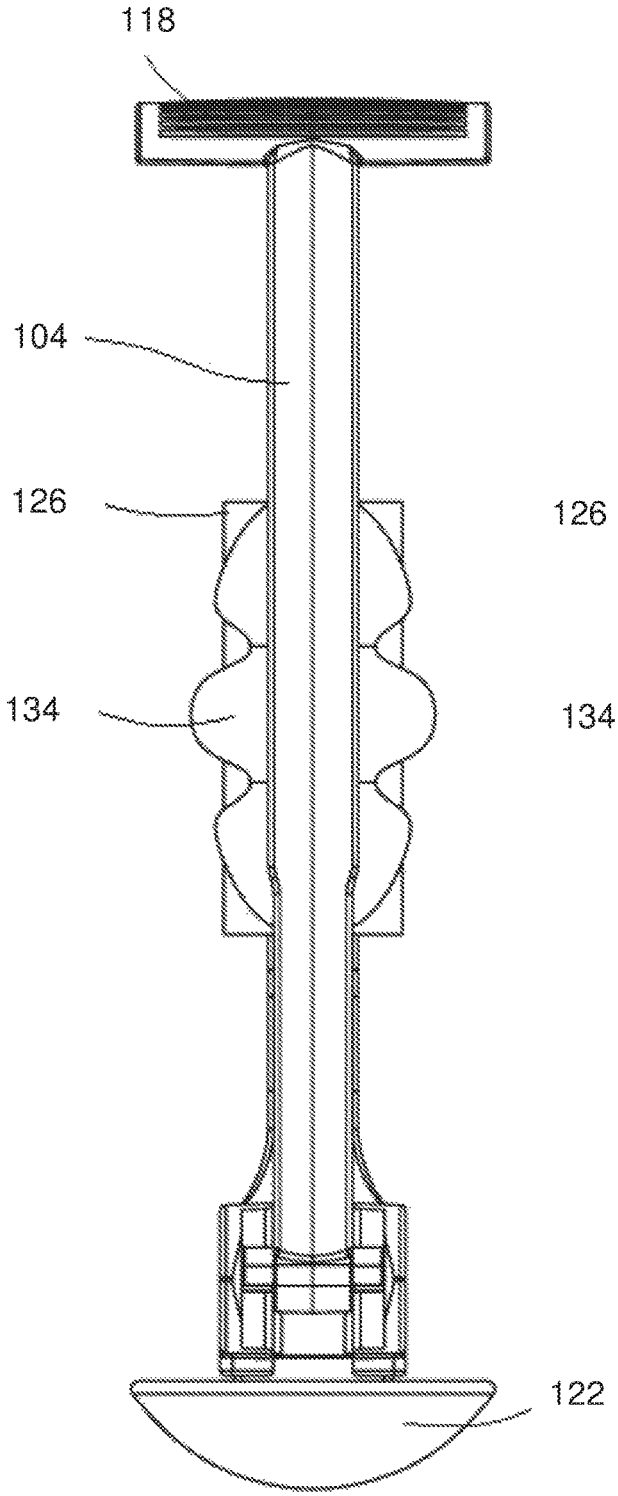
FIG. 2 is a first side view of the body massaging apparatus of FIG. 1.
Figure 3:
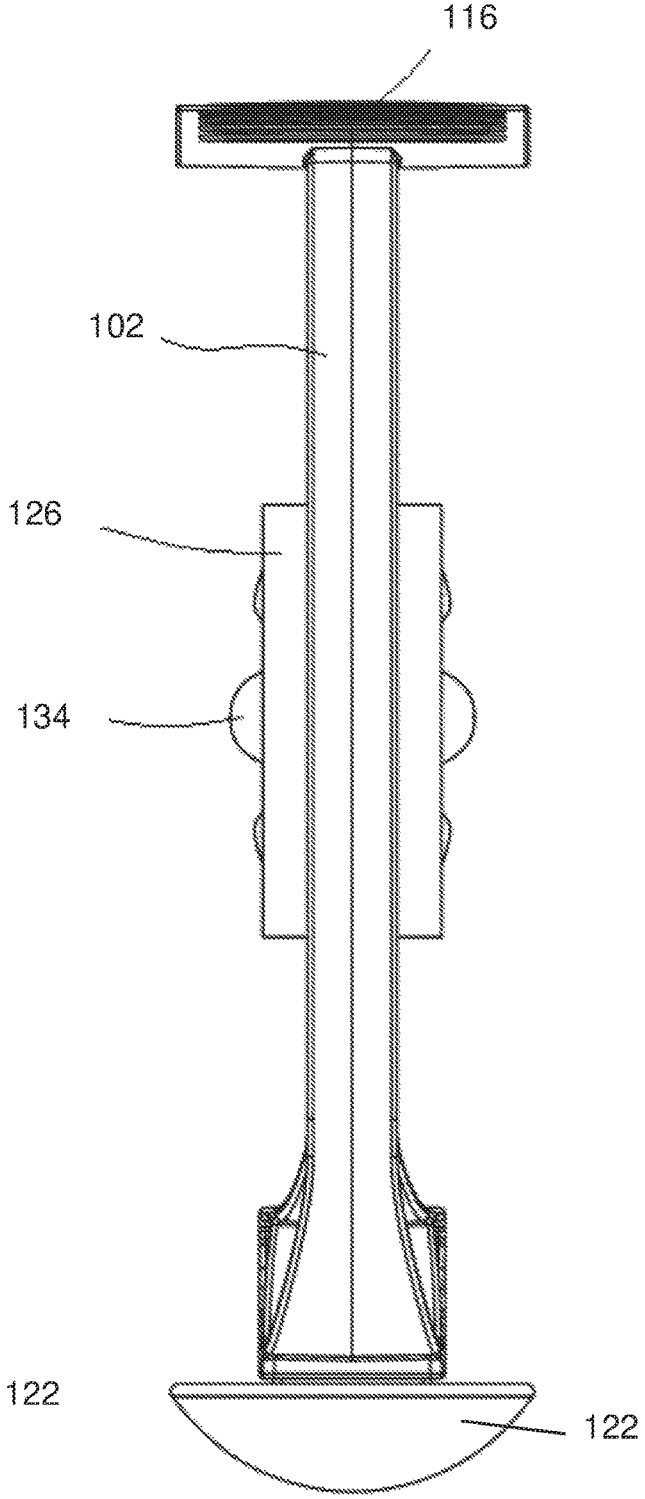
FIG. 3 is a second side view of the body massaging apparatus of FIG. 1.
Figure 4:
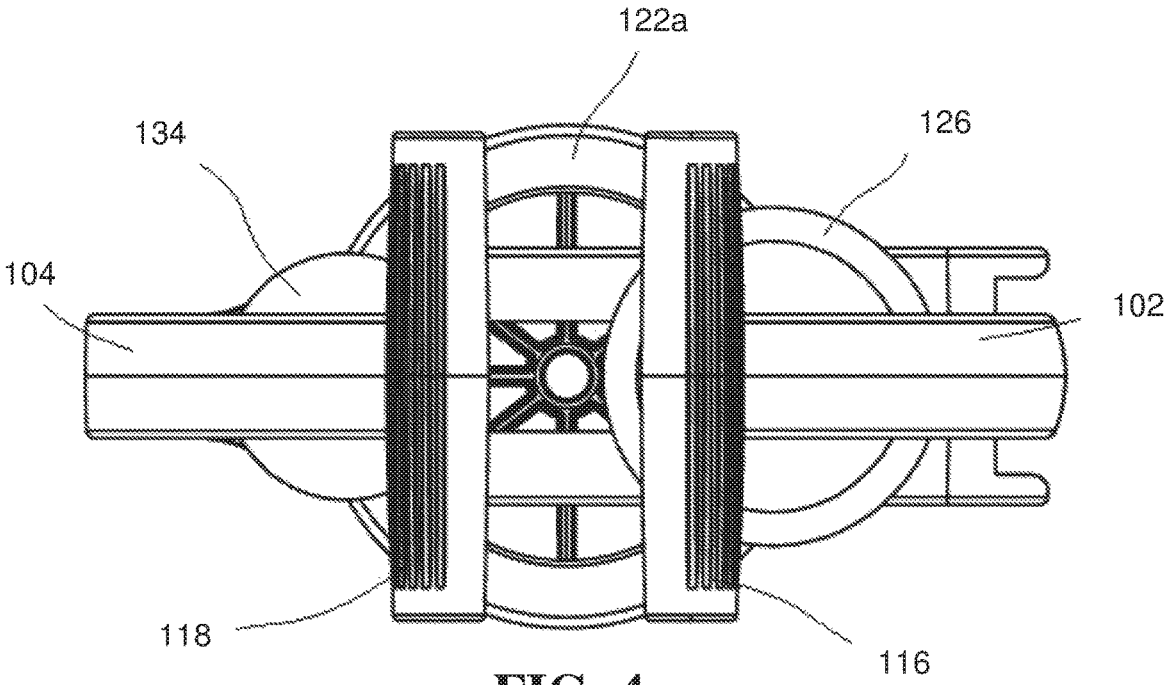
FIG. 4 is a top view of the body massaging apparatus of FIG. 1.
Figure 5:
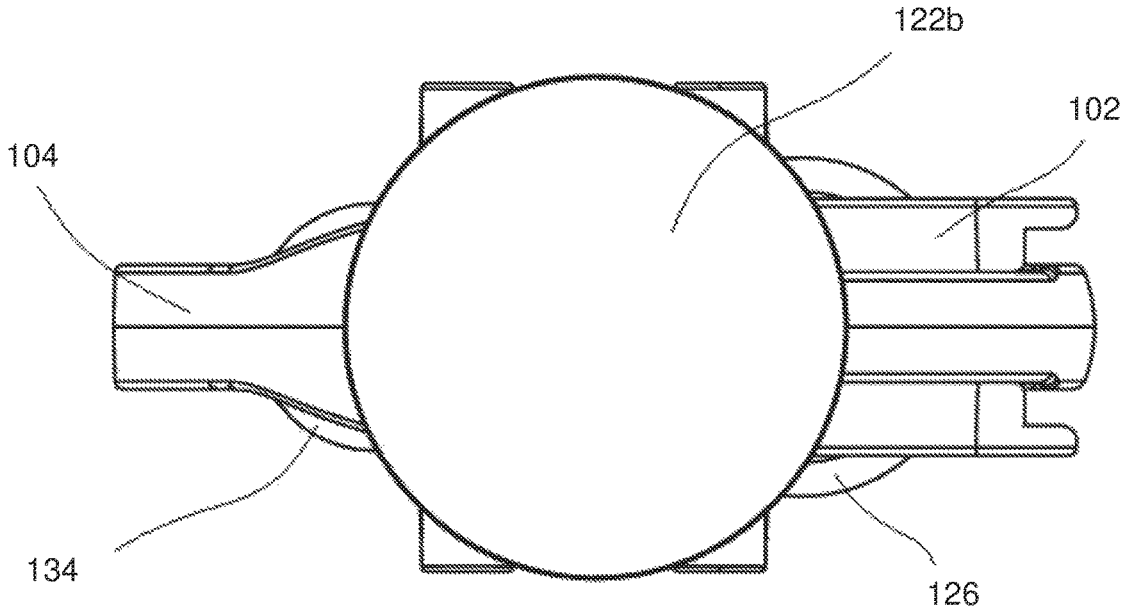
FIG. 5 is a bottom view of the body massaging apparatus of FIG. 1.
Figure 6:
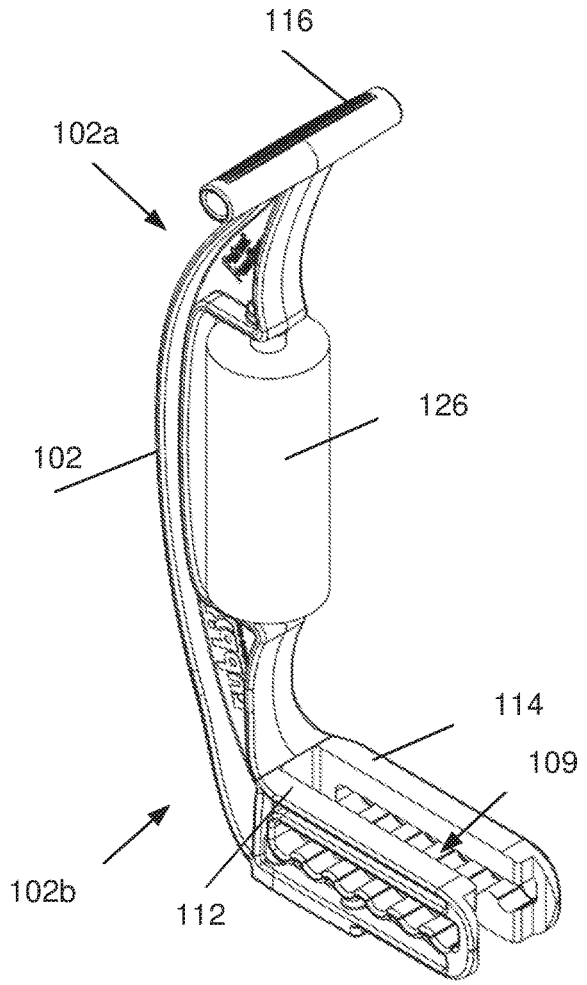
FIG. 6 is a side perspective view of a first arm of the body massaging apparatus of FIG. 1.
Figure 7:
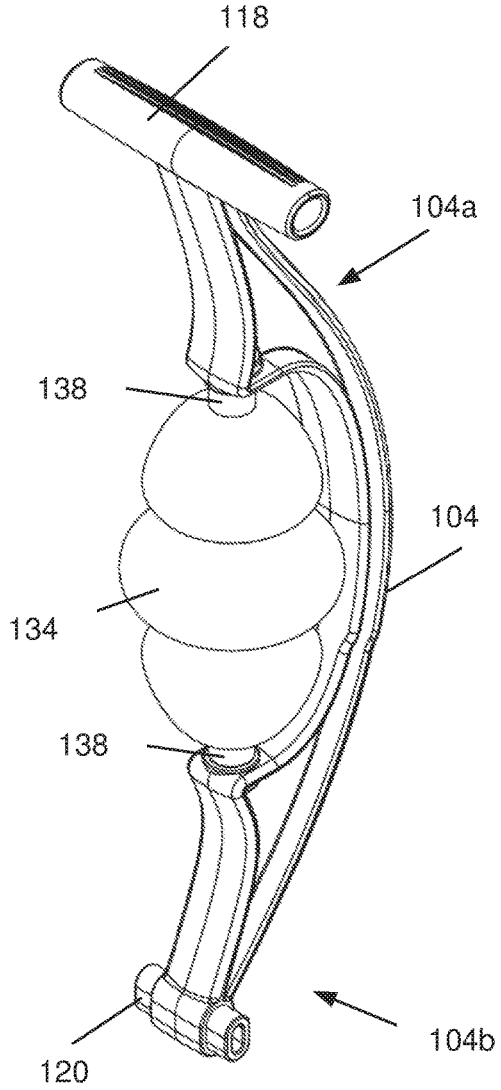
FIG. 7 is a side perspective view of a second arm of the body massaging apparatus of FIG. 1.
Figure 8:
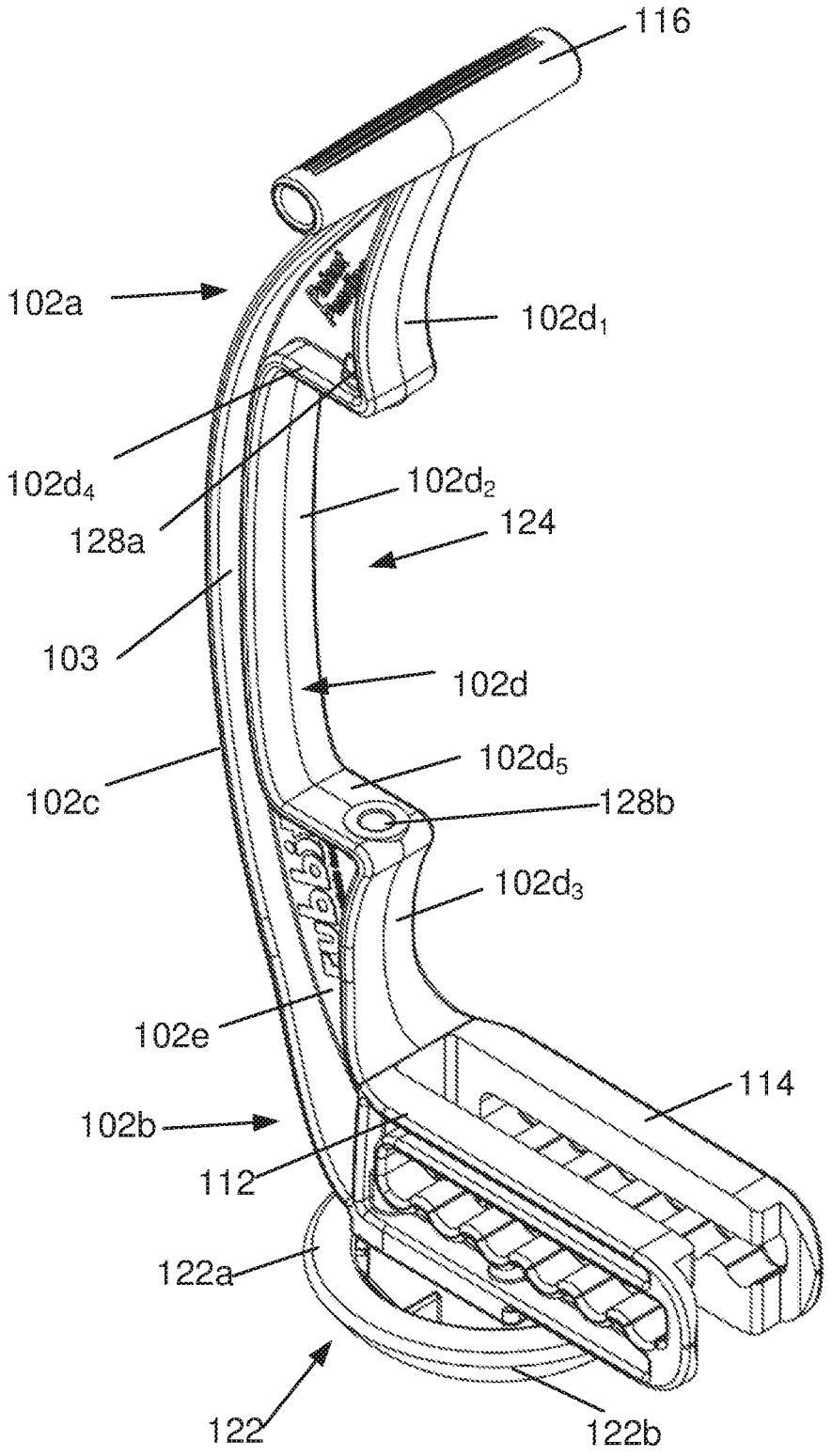
FIG. 8 is a side perspective view of the first arm of the body massaging apparatus of FIG. 1 without a massaging member.
Figure 9:
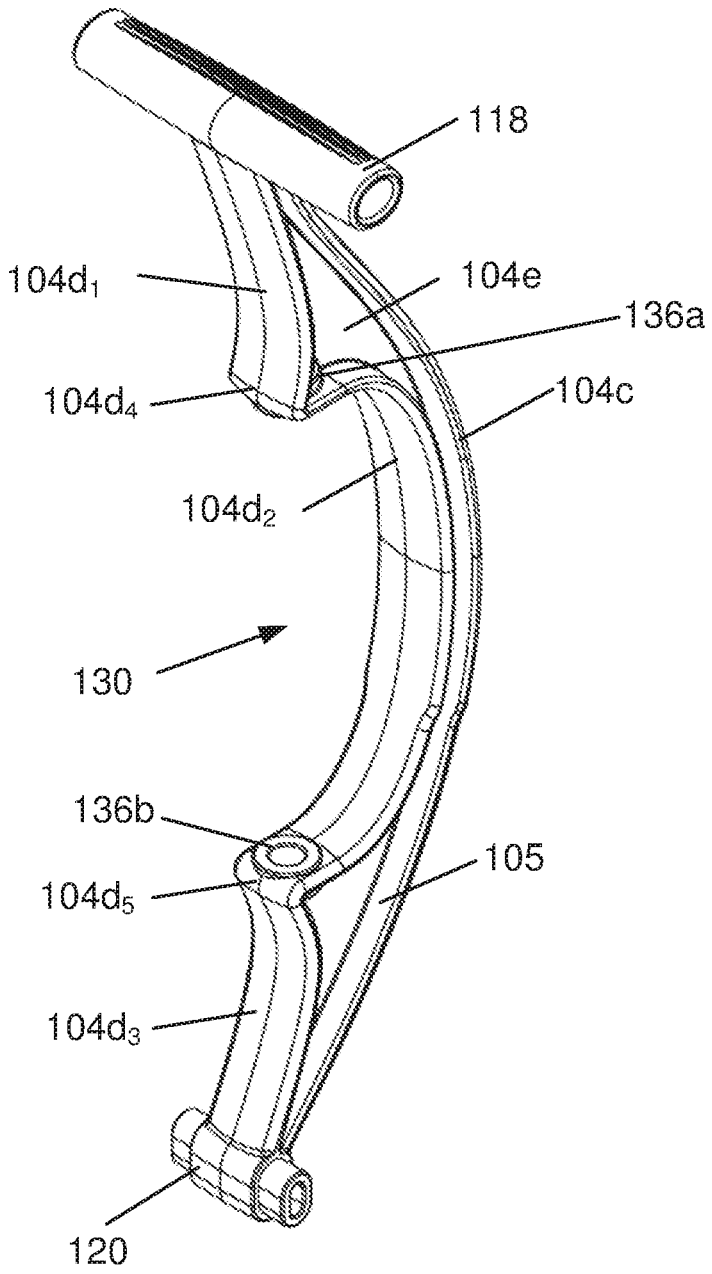
FIG. 9 is a side perspective view of the second arm of the body massaging apparatus of FIG. 1 without a massaging member.

FIG. 1 is a side perspective view of a body massaging apparatus, according to one aspect. FIG. 2 is a first side view of the body massaging apparatus of FIG. 1. FIG. 3 is a second side view of the body massaging apparatus of FIG. 1. FIG. 4 is a top view of the body massaging apparatus of FIG. 1. FIG. 5 is a bottom view of the body massaging apparatus of FIG. 1. FIG. 6 is a side perspective view of a first arm of the body massaging apparatus of FIG. 1. FIG. 7 is a side perspective view of a second arm of the body massaging apparatus of FIG. 1. FIG. 8 is a side perspective view of the first arm of the body massaging apparatus of FIG. 1 without a massaging member. FIG. 9 is a side perspective view of the second arm of the body massaging apparatus of FIG. 1 without a massaging member. The following discussion refers interchangeably to FIGS. 1-9.

As shown, the body massaging apparatus 100 may include a first arm 102, having a first arm upper end 102*a* and a first arm lower end 102*b*, and a second arm 104, having a second arm upper end 104*a* and a second arm lower end 104*b*. The first and second arms 102, 104 may be maintained in an adjustable relationship to each other. That is, the first and second arms 102, 104 may be set by the user at various discrete distances from each other to create a desired gap or space between the arms 102, 104 by moving or rotating one or both of the arms along an axis perpendicular to mounting axes of the massaging members. The size of the gap is adjustable so that the gap can be adapted to receive and accommodate a body part to which the body massaging apparatus 100 is being used on. Large gaps being necessary to accommodate larger body parts, such as legs and arms, with smaller gaps being necessary to accommodate smaller body parts, such as fingers. According to one aspect, the second arm 104 may be removable from the first arm 102 and used independently of the apparatus as a whole to massage body parts that otherwise would not fit between the arms 102, 104 of the body massaging apparatus 100.

A first handle 116 may be integrally connected to, and extend perpendicularly outward from, the first arm upper end 102*a* and a second handle 118 may be integrally connected to, and extend perpendicularly outward from, the second arm upper end 104*a*. Although the first and second handles 116, 118 are shown as having elongated tubular configurations, this is by way of example only and the first and second handles 116, 118 may utilize any configuration known in the art and may be solid instead of tubular.

The first arm lower end 102*b* may include a first elongated member 106 integrally connected to, and extending perpendicularly outward from, a first side of the first arm 102 and a second elongated member 108 may be integrally connected to, and extending perpendicularly outward, from a second side of the first arm 102. The first elongated member 106 may be separated from the second elongated member 108 forming a space or channel 109 adapted or configured to receive the second arm lower end 104*b* of the second arm 104.

Each of the first and second elongated members 106, 108 may have a generally rectangular configuration and include a slotted guideway 112 and 114, respectively, having corresponding discrete pairs of depressions along its length. The depressions may be adapted or configured to receive and engage with a securing member 120 located on the second arm lower end 104*b* allowing the second arm 104 to rotate relative to the first arm and along an axis perpendicular to the mounting axes of massaging members, described below.

A securing member 120 may be integrally connected to the second arm lower end 104*b* and adapted to be received within the slotted guideways 112, 114 of the first elongated member 106 and the second elongated member 108 each having a plurality of depressions. For example, the securing member 120 may be inserted into the slotted guideways 112, 114 of the first and second elongated members 106, 108 of the first arm 102 and then aligned with one of the pairs of depressions (that is a depression from each of the slotted guideways 112, 114) to achieve a desired relative positioning of the first and second arms 102, 104. Next, the second arm 104 may be pivoted into a substantially parallel orientation to the first arm 102, causing the securing member 120 to engage with a pair of depressions and maintain the spacing of the arms 102, 104 as desired. As described above, a user may place a body part between the two arms of the apparatus to be acted upon by massaging members secured to medial portions of each of the arms, whereby the body part is adjustably clamped between the pair of massaging members and massaged by translating and rotating movements of the body part along an axis perpendicular to the mounting axes of the massaging members.

According to one aspect, a base 122 may be connected, either fixedly or removably, to the bottom surfaces of the slotted guideways 112 and 114 at the first arm lower end 102*b*. The base 122 may have a substantially planar upper portion 122*a* and a lower portion 122*b* have a generally circular or rounded configuration, such as a portion of a sphere. The lower portion 122*b* of the base 122 may be made of, or covered with, a high-stick, non-skid material, so that the body massaging apparatus 100, when placed on a surface, remains substantially in place during use. The rounded shape of the lower portion 122*b* of the base 122 (when in contact with a surface or other object) allows the body massaging apparatus 100 to be pivoted in relation to the surface in order to precisely orient the body massaging apparatus 100 at any desired angle. The surface upon which the base 122 may be placed, for example, include a table top, the floor, the thigh or other body part of a user, a wall, or any other suitable surface. The base 122 of the body massaging apparatus 100 may also be used as a handle to support the position and movement of the body massaging apparatus 100, for example, when the body massaging apparatus 100 is used on a leg (rather than moving the leg through a stationary device, the body massaging apparatus 100 is moved over the stationary leg). In this example, the user's other hand grasps the first and second handles 116, 118 to regulate pressure being applied to the leg.

The first arm 102 may have an outer surface 102*c* and an inner surface 102*d* separated by and integrally connected, to an inner wall 102*e* of the first arm 102. According to one aspect, the thickness of the inner wall 102*e* may be smaller than the widths of the outer and inner surfaces 102*c*, 102*d* forming a ridge or lip 103 allowing for a user to easily grasp the first arm 102. The inner surface 102*d* may have a first opening or cavity 124 adapted or configured to receive a first massaging member 126. (See FIG. 1) According to one example, the outer surface 102*c* of the first arm 102 may have a generally continuous arcuate shape while the inner surface 102*d* may include an upper portion $\mathbf{102}d_1$, a medial portion $\mathbf{102}d_2$ and a lower portion $\mathbf{102}d_3$ where the medial portion $\mathbf{102}d_2$ is integrally connected between the upper portion $\mathbf{102}d_1$ and the lower portion $\mathbf{102}d_3$. The medial portion $\mathbf{102}d_2$ may be connected to the upper portion $\mathbf{102}d_1$ by an upper edge portion $\mathbf{102}d_4$ and the lower portion $\mathbf{102}d_3$ by a lower edge portion $\mathbf{102}d_5$. According to one example, the upper edge portion 102*d*4 and the lower edge portion $\mathbf{102}d_5$ may extend substantially perpendicularly outward from the upper and lower ends of the medial portion $\mathbf{102}d_2$, respectively, creating or forming the first cavity 124 in the first arm 102. Although all portions $\mathbf{102}d_1$-$\mathbf{102}d_3$ are shown having an arcuate shape, this is by way of example only. As shown in FIG. 8, the upper portion $\mathbf{102}d_1$ and the lower portion $\mathbf{102}d_3$ are located within a first vertical plane and the medial portion $\mathbf{102}d_2$ is located within a second vertical plane where the first vertical plane is different than the second vertical plane.

According to one aspect, the upper edge portion $\mathbf{102}d_4$ of the inner surface 102*d* of the first arm 102 may include a first aperture 128*a* and the lower edge portion $\mathbf{102}d_5$ of the inner surface 102*d* of the first arm 102 may include a second aperture 128*b*. The first massaging member 126 may have an elongated configuration including a roller secured or mounted to a substantially rigid shaft 130 adapted or configured to be received within the first and second apertures 128*a*, 128*b* securing the first massaging member 126 to the first arm 102. The first massaging member 126 may be rotatable by the roller rotating around the shaft 130 or the shaft 130 being rotatable when secured within the first and second apertures 128*a*, 128*b*. The roller may be formed of any type of material known in the art such as foam, rubber or plastic.

As shown in FIG. 9, the second arm 104 may have an outer surface 104*c* and an inner surface 104*d* separated by and integrally connected to an inner wall 104*e*. According to one aspect, the thickness of the inner wall 104*e* may be smaller than the widths of the outer and inner surfaces 104*c*, 104*d* forming a ridge or lip 105 allowing for a user to easily grasp the second arm 104. The inner surface 104*d* of the second arm may have a second opening or cavity 132 adapted or configured to receive a second massaging member 134. (See FIG. 1) According to one example, the outer surface 104*c* may have a generally continuous arcuate shape while the inner surface 104*d* may include an upper portion 104$d_1$, a medial portion 104$d_2$ and a lower portion 104$d_3$ where the medial portion 104$d_2$ is integrally connected between the upper portion 104$d_1$ and the lower portion 104$d_3$. The medial portion 104$d_2$ may be connected to the upper portion 104$d_1$ by an upper edge portion 104$d_4$ and the lower portion 104$d_3$ by a lower edge portion 104$d_5$. According to one example, the upper edge portion 104$d_4$ and the lower edge portion 104$d_5$ may extend substantially perpendicularly outward from the medial portion 104$d_2$ creating or forming the second cavity 130 in the second arm 104. Although all portions 104$d_1$-104$d_3$ are shown having an arcuate shape, this is by way of example only and may have any other shape. As shown in FIG. 9, the upper portion 104$d_1$ and the lower portion 104$d_3$ are located within a first vertical plane and the medial portion 104$d_2$ is located within a second vertical plane where the first vertical plane is different than the second vertical plane.

According to one aspect, the upper edge portion 104$d_4$ of the inner surface 104*d* of the second arm 104 may include a first aperture 136*a* and the lower edge portion 104$d_5$ of the inner surface 104*d* of the second arm 104 may include a second aperture 136*b*. The second massaging member 134 may include a multi-curved contoured roller secured or mounted to a substantially rigid shaft 138 adapted or configured to be received within the first and second apertures 136*a*, 136*b* securing the second massaging member 134 to the second arm 104. The second massaging member 126 may be rotatable by the multi-curved contoured roller rotating around the shaft 138 or the shaft 138 being rotatable when secured within the first and second apertures 136*a*, 136*b*. Alternatively, the second massaging member may remain in a fixed stationary (i.e. not rotatable) position. The multi-curved contoured roller may be made from any type of material known in the art including a resilient material such as foam or rubber. The unique shape of the multi-curved contoured roller is designed to properly perform various desired therapy techniques as is known in the art. According to one example, the second massaging member 134 "gives" (e.g., is resilient and flexible) to absorb the necessary flex when under use. It also has specifically designed curves to give the necessary intensity on particular spots so effective therapy can be performed.

Figure 10:
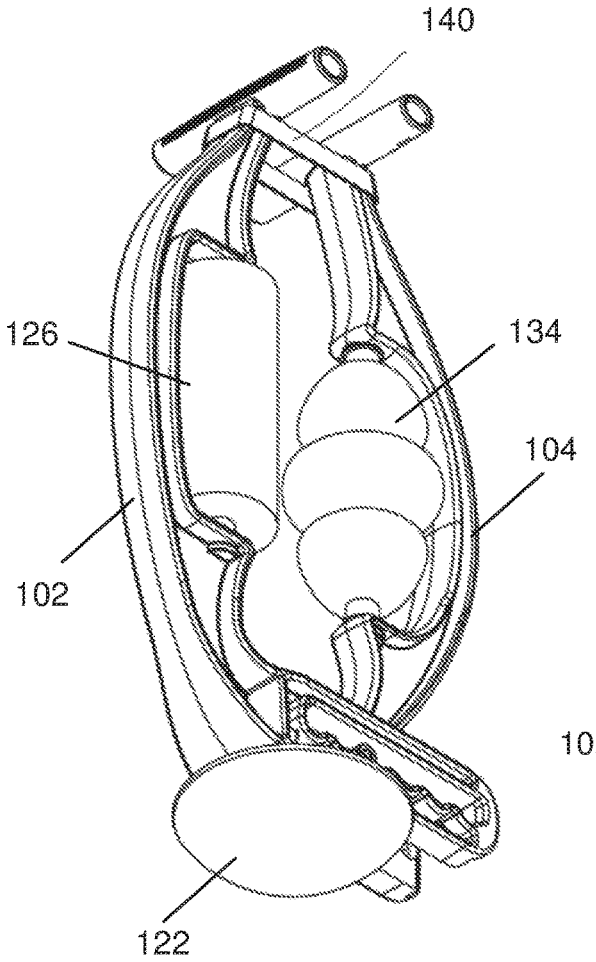
FIG. 10 is a side perspective view of the body massaging apparatus of FIG. 1 utilizing a tensioning device, according to one aspect.
Figure 11:
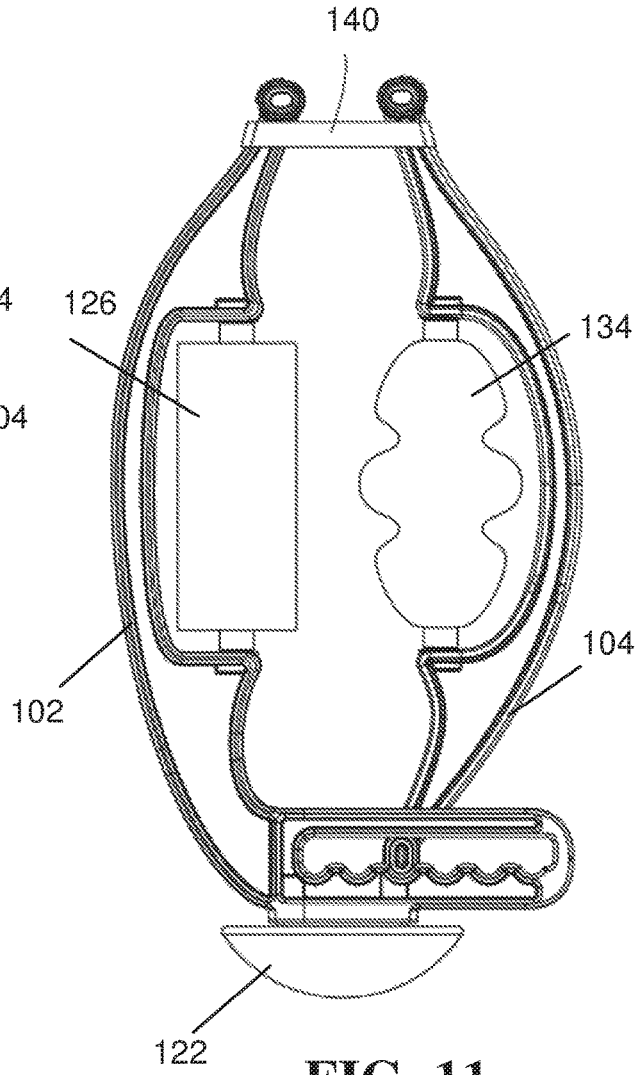
FIG. 11 is a side plan view of the body massaging apparatus of FIG. 10.

When the first and second arms 102, 104 of the body massaging apparatus 100 are used together, a user may place or insert a body part between them allowing the user to perform various different desired therapy techniques known in the art. As shown in FIGS. 10 and 11, the body massaging apparatus 100 may further comprise a tensioning device 140. The tensioning device 140 may be adapted to be placed around the first arm upper end 102*a* and the second arm upper end 104*a* below the first and second handles 116, 118 respectively, to maintain or hold the first and second arms 102, 104 together in close proximity to each other. The tensioning device 140 may be used to supplement the user's hand in holding the first and second arms 102, 104 in close proximity to each other, or replace the use of the user's hand altogether freeing up the hand of the user.

According to one example, the tensioning device 140 may be made of an elasticized material, such as a rubber band or a bungee cord, however a non-elasticized material may also be used. Use of an elasticized material allows the first and second arms 102, 104 to apply an inward force directed towards each other while also providing for some amount of "give" with the first and second arms 102, 104 being able to move apart from each other when necessary, for example, when the body massaging apparatus 100 is moved over an ankle or a knee, for example.

The tensioning device 140 may be wrapped one or more times around the first arm upper end 102*a* and the second arm upper end 104*a* of the first and second arms 102, 104. Each successive wrapping of the tensioning device 140 may increase the tension so that the first and second arms 102, 104 may apply greater force on the body part placed between the first and second arms 102, 104 of the body massaging apparatus 100. Alternatively, the tensioning device 140 may comprise multiple elasticized bands of different lengths and/or thicknesses, each providing a different amount of tension. Multiple bands may be used simultaneously to achieve different tensions, as required or desired.

According to another example, the tensioning device 140 may have a first end and a second end, with an elasticized band between the first and second ends. A fastener, such as a hook and loop fastener (e.g. Velcro™) fastener may be used to removably attach the first end to the second end. As the fastener is adjustable, the tension of the tensioning device 140 may be adjusted. Thus, where a greater portion of the hook and loop elements of the fastening device are overlapped with each other, the overall length of the tensioning device 140 is shortened and the tensioning device 140 provides greater tension; and where a lesser portion of the hook and loop elements of the fastener are overlapped with each other, the overall length of the tensioning device 140 is lengthened and the tensioning device 140 provides less tension. Snaps, buckles, hooks, and other known fastening devices may also be to fasten the first and second ends of the tensing device 140.

Figure 12:
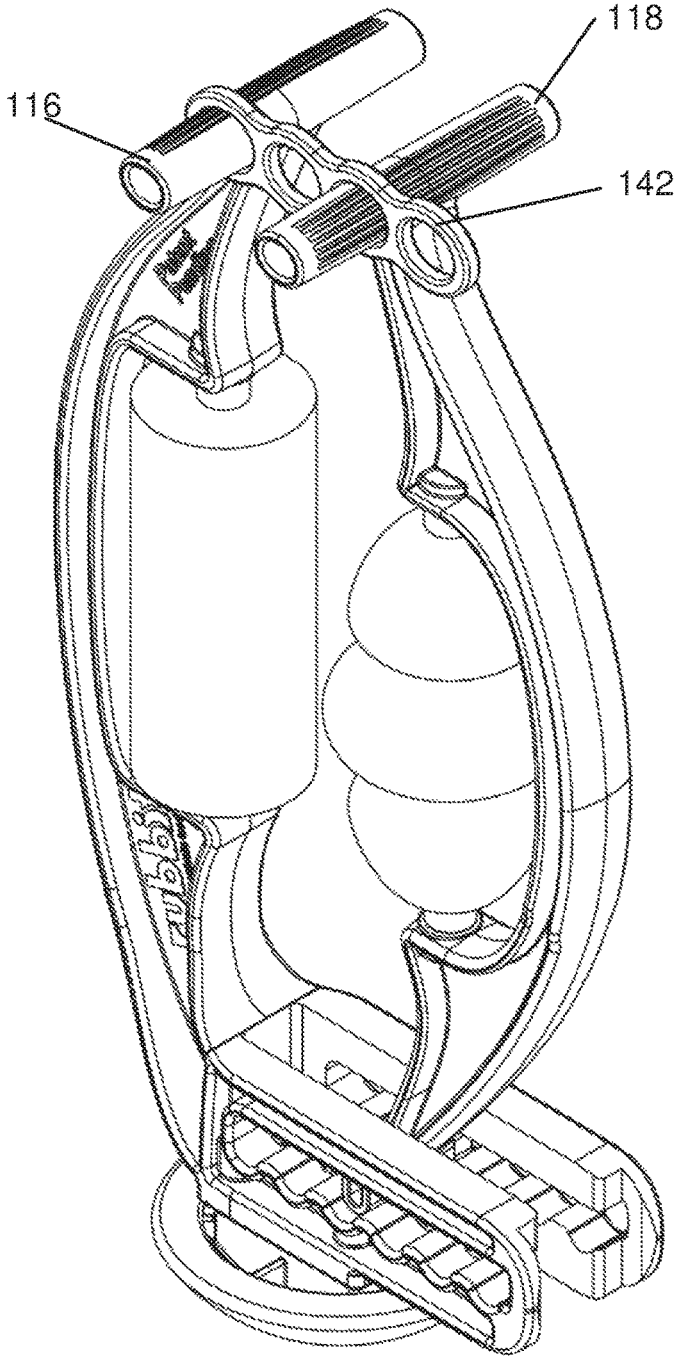
FIG. 12 is a side perspective view of the body massaging apparatus of FIG. 1 utilizing a tensioning device, according to another aspect.
Figure 13:
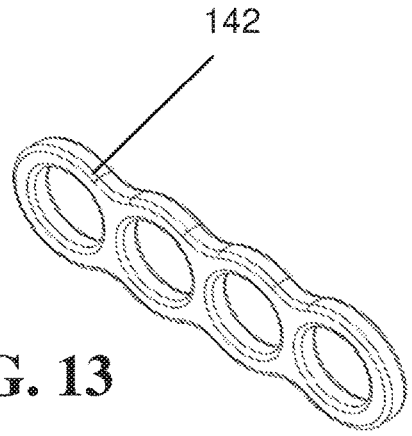
FIG. 13 is a side perspective view of the tensioning device in FIG. 12.
Figure 14:
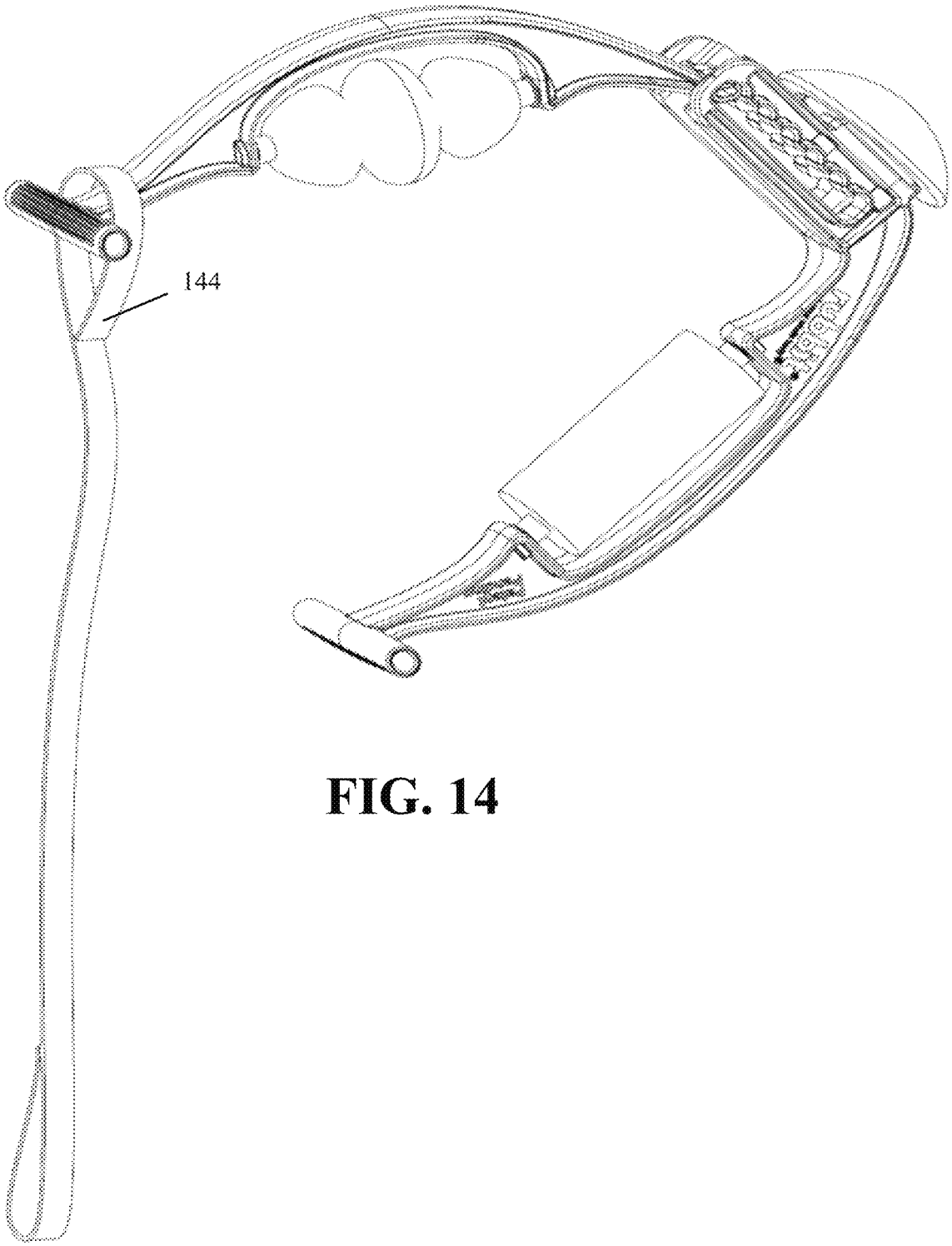
FIG. 14 is a perspective view of the body massaging apparatus of FIG. 1 utilizing a strap, according to one aspect.

Turning to FIGS. 12 and 13, another example of a tensioning device 142 is shown. The tensioning device 142 may be substantially flat having a plurality of holes adapted or configured to receive the first and second handles 116, 118 of the body massaging apparatus 100. The tensioning device 140 may be used by placing one hole over the first handle 116 and a second hole over the second handle 118. As the tensioning device 142 has a plurality of holes, the distance between the handles 116, 118 (and thus the first and second arms 102, 104) may be adjusted as desired by the user.

According to yet another example, an elongated strap 144 may be utilized by a user to position the first arm 102 or the second arm 104.

Figure 15:
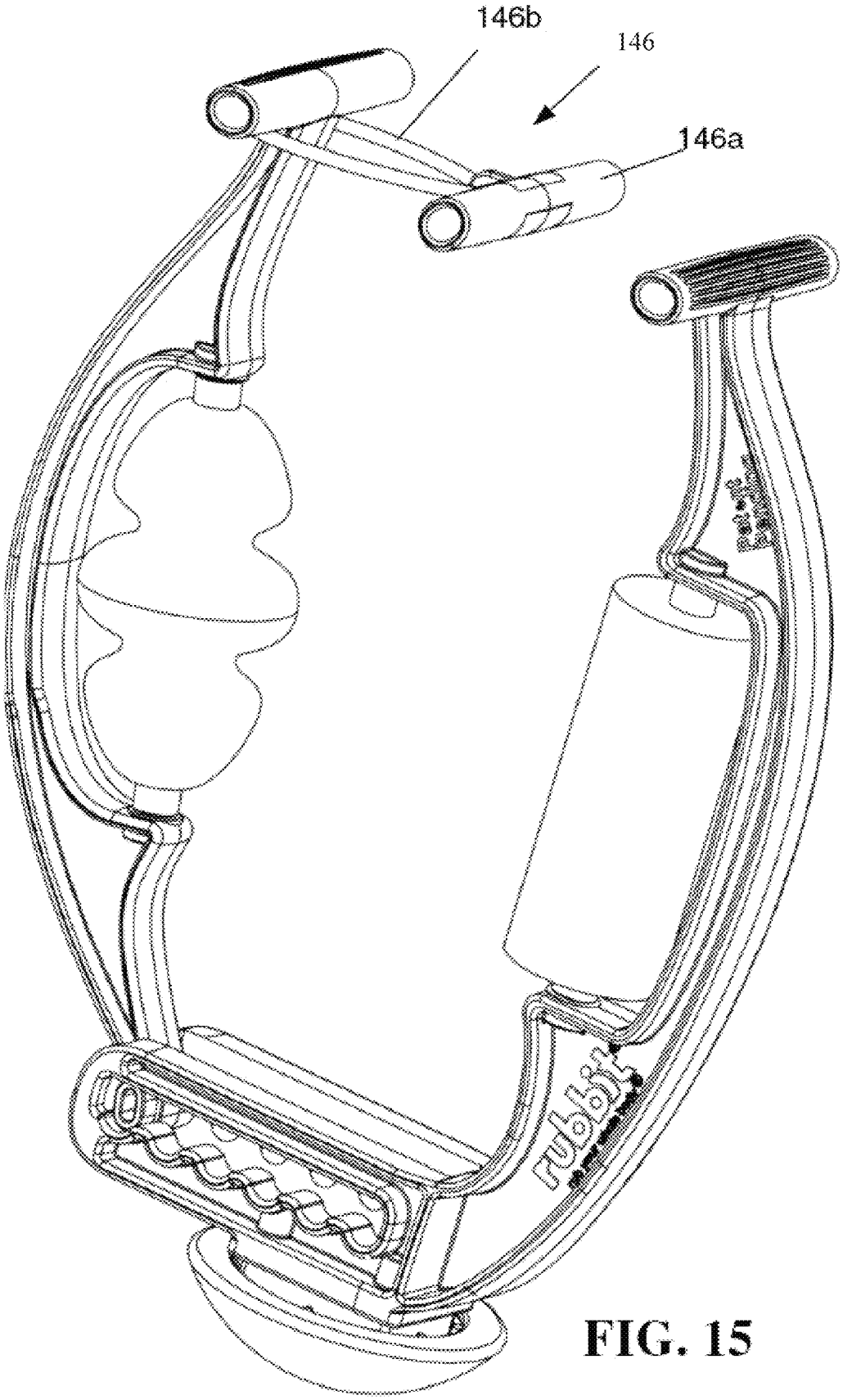
FIG. 15 is a perspective view of the body massaging apparatus of FIG. 1 utilizing a toggle, according to one aspect.
Figure 16:
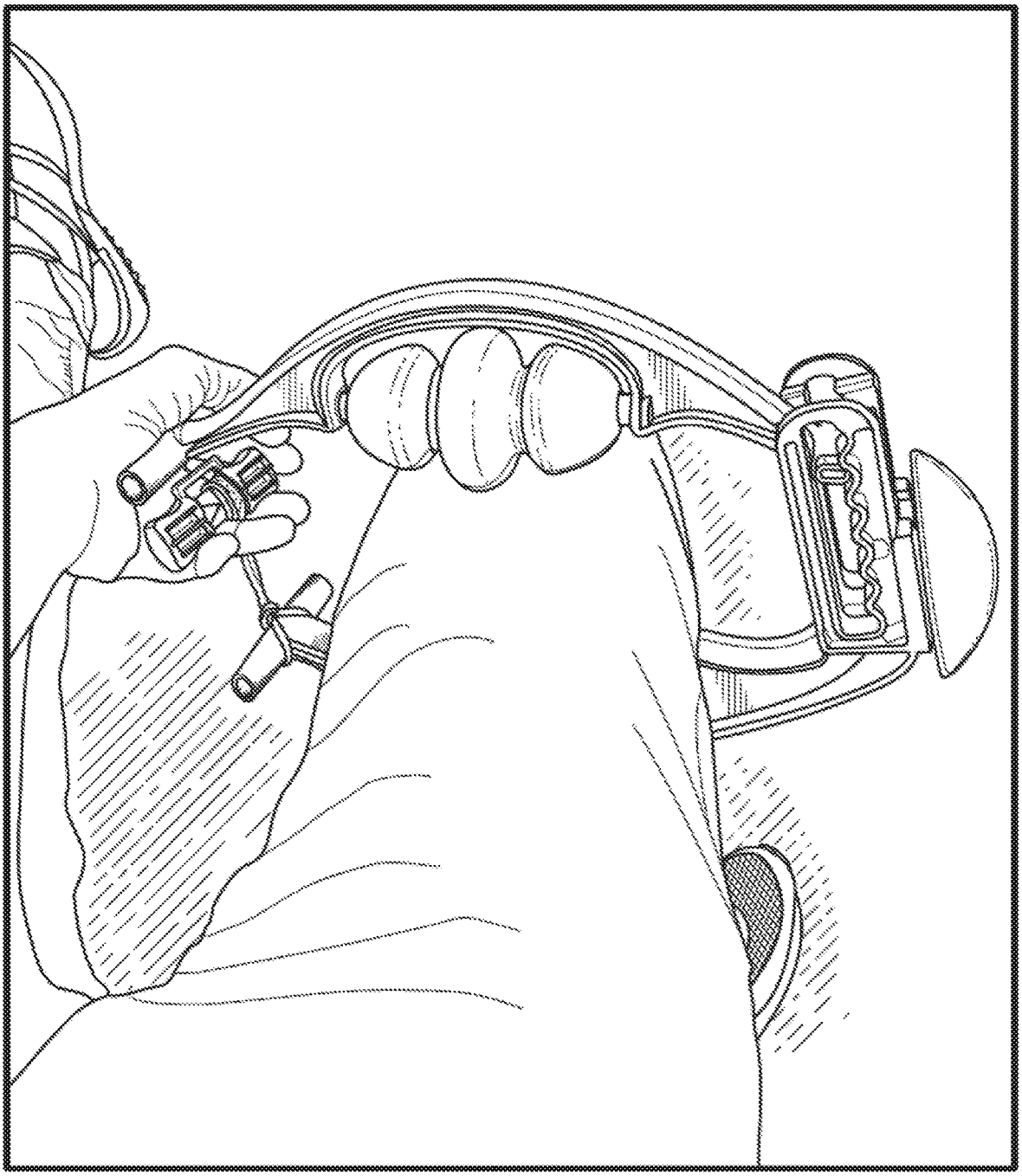
FIG. 16 illustrates the use of the body massaging apparatus of FIG. 15 by a user.

According to yet another example, a toggle 146 may be utilized to assist the user in holding onto both the first and second handles 116, 118 with a single hand. (See FIG. 15) The toggle 146 may comprise an elongated member 146*a* and a band or cord 146*b*. The elongated member 146*a* may be solid or tubular and made of any type of rigid material known in the art while the cord 146*b* may be made from an elasticized or non-elasticized material and form a loop such that the cord 146*b* may be placed around the first arm upper end 102*a* or the second arm upper end 104*a* of the first and second arms 102, 104. FIG. 16 illustrates the use of the body massaging apparatus 100 of FIG. 15 by a user. As shown in FIG. 16, a leg of the user is inserted between the first and second arms 102, 104 of the body massaging apparatus 100. A normal leg of a user increases in size which causes the gap between the first and second handles 116, 118 to increase the farther up the leg the body massaging apparatus 100 is moved. As the user is limited by the size of his or her hand, the user may not be able to hold onto the first and second handle 116, 118 with a single hand the farther up the leg the body massaging apparatus 100 is moved. The toggle 146 may be utilized by the user to assist with holding the first and second handles 116, 118 together in such situations. As shown, the cord 146*a* of the toggle 146 may be wrapped around one of the handles while the user holds onto the elongated member allowing the gap or distance between the handles 116, 118 to increase without the user having to struggle to grasp both handles 116, 118.

Massaging Members

Figure 17:
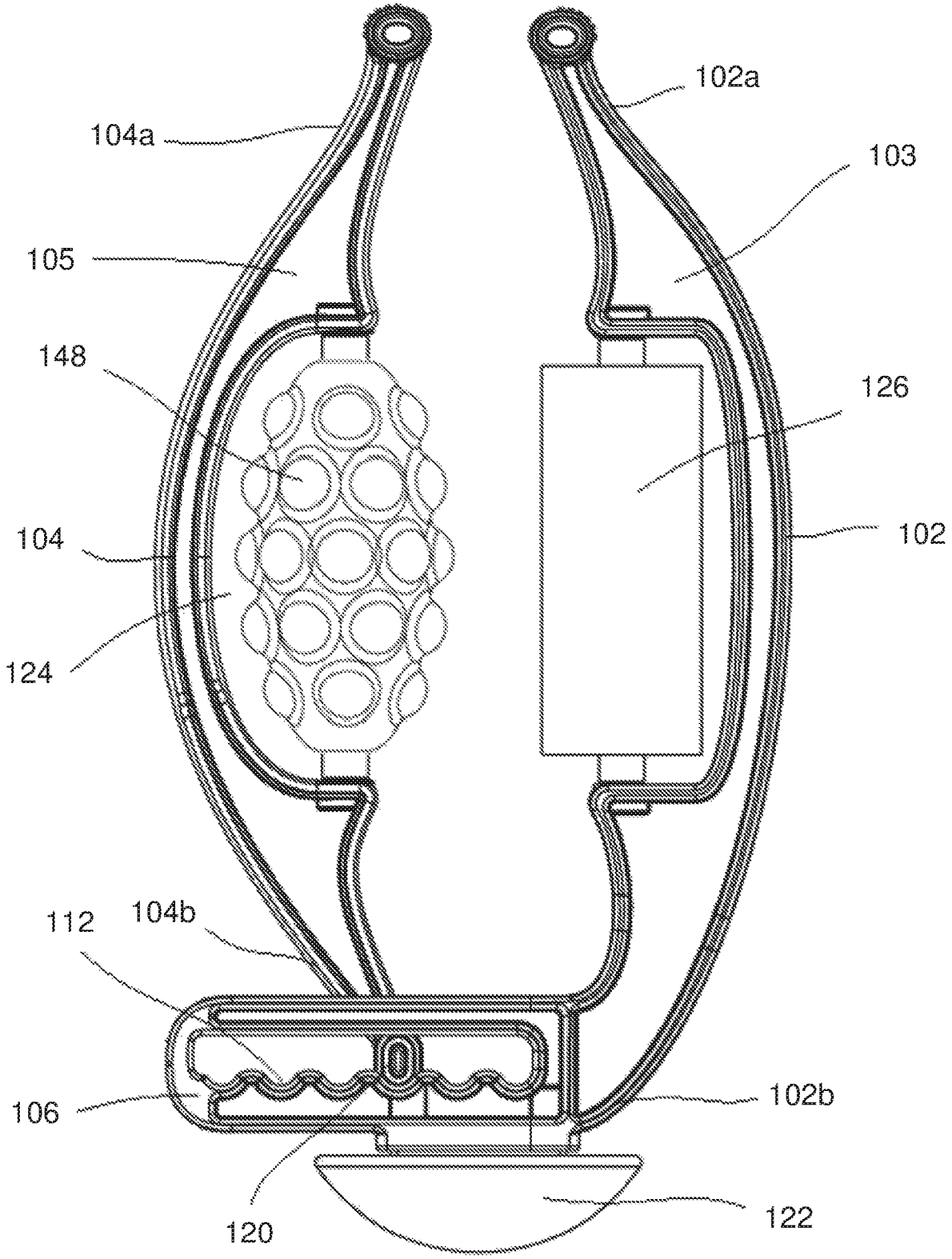
FIG. 17 is a side plan view of the body massaging apparatus of FIG. 1 having a differently configured massaging member.
Figure 18:
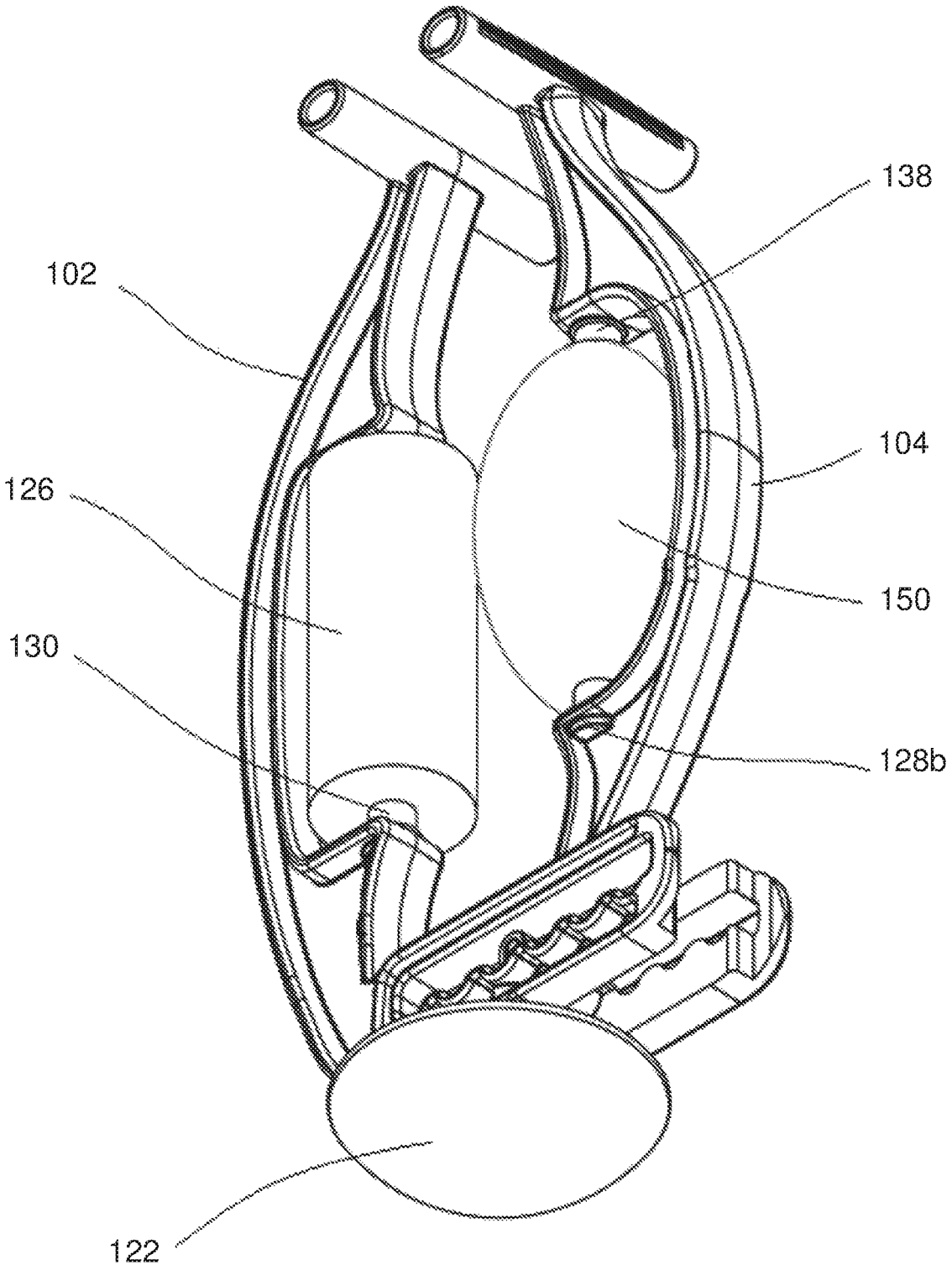
FIG. 18 is a side plan view of the body massaging apparatus of FIG. 1 having yet another differently configured massaging member.

To accommodate different uses of the body massaging apparatus and the needs of user, the massaging members may have different configurations. For example, in one configuration, the massaging member 134 may have a tripart shape, with a medial bulge. (See FIGS. 1-4, 7, 10-13, 15, 16, 19 and 20) In another configuration, the massaging member 150 may have a substantially ovoid, or egg, shape. (See FIG. 18) In yet another configuration, the massaging member 148 may have a substantially ovoid shape with a plurality of protrusions, or nubs, extending from its surface. (See FIG. 17) The configurations of the massaging members shown are by way of example and other configurations known in the art may be utilized.

Figure 19:
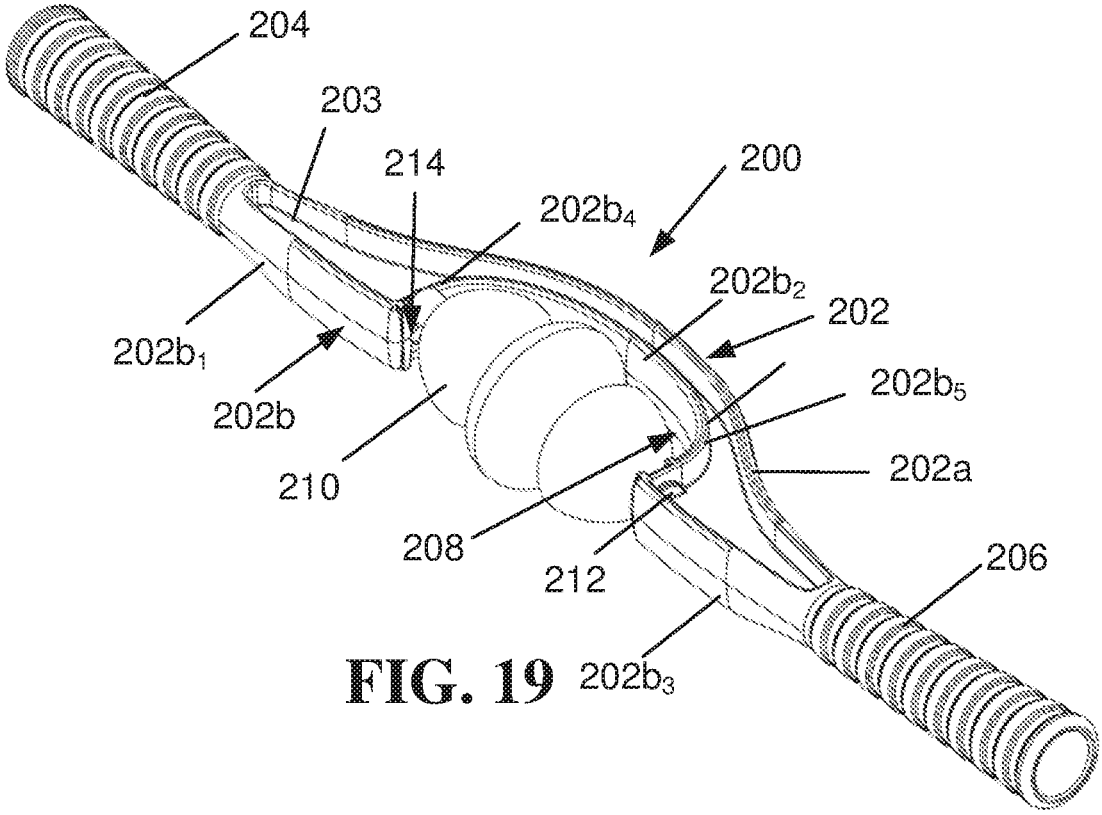
FIG. 19 is a perspective view a body massaging apparatus having a massaging member being inserted according to another aspect.
Figure 20:
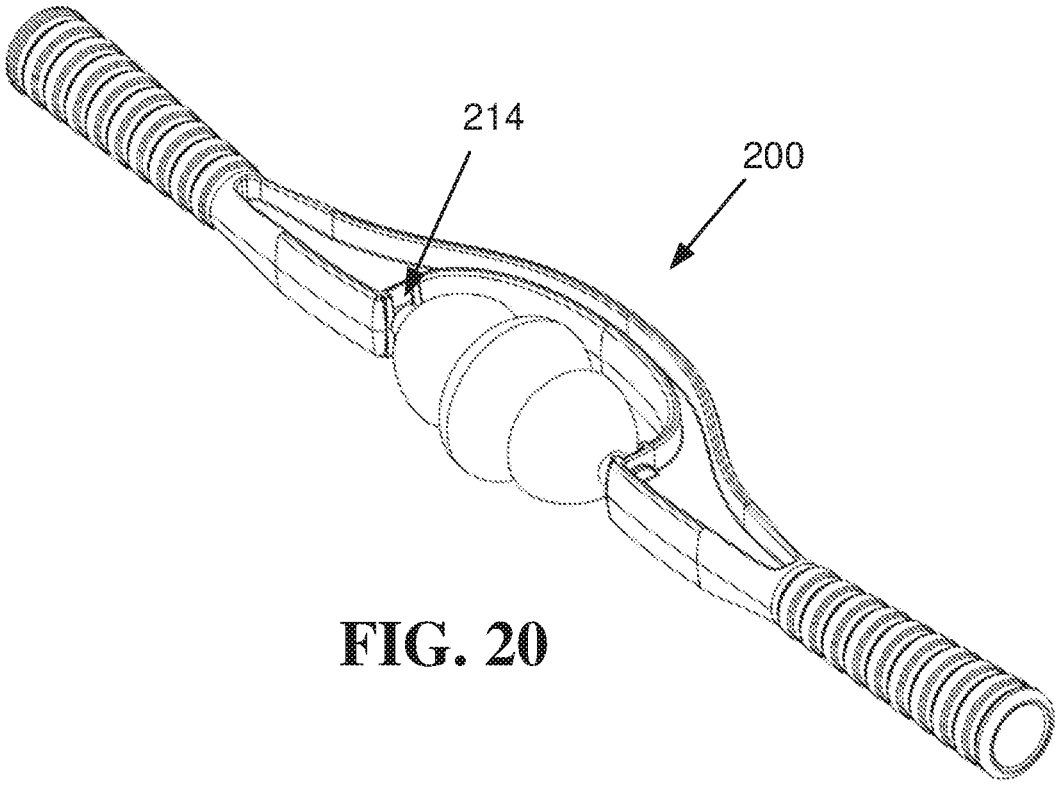
FIG. 20 is a perspective view of the body massaging apparatus of FIG. 20 with the massaging member fulling inserted.

Certain body parts, such as the back or the neck, cannot be placed between the first and second arms 102, 104 of the body massaging apparatus 100. In those cases, the second arm 104 may be removed from the first arm 102 and used independently of the remainder of the body massaging apparatus 100. FIGS. 19 and 20 illustrate a body massaging apparatus 200 according to another aspect where a single arm is utilized. The body massaging apparatus 200 may include a single arm 202 having a first grip 204 at a first end and a second grip 206 at a second end. As with the second arm 104 of the body massaging apparatus 100 shown in FIG. 9, the single arm 202 of the body massaging apparatus 200 may include an arcuate outer surface 202*a*. The inner surface 202*b*, integrally connected to the outer surface by an inner wall 203, may include an upper portion $\mathbf{202}b_1$, a medial portion $\mathbf{202}b_2$ and a lower portion $\mathbf{202}b_3$ where the medial portion $\mathbf{202}b_2$ is integrally connected between the upper portion $\mathbf{202}b_1$ and the lower portion $\mathbf{202}b_3$. The medial portion $\mathbf{202}b_2$ may be connected to the upper portion $\mathbf{202}b_1$ by an upper edge portion $\mathbf{202}b_4$ and the lower portion $\mathbf{202}b_3$ by a lower edge portion $\mathbf{202}b_5$. According to one example, the upper edge portion $\mathbf{202}b_4$ and the lower edge portion $\mathbf{202}b_5$ may extend substantially perpendicularly outward from the medial portion $\mathbf{202}b_2$ creating or forming second cavity 208 in the single arm 202. A massaging apparatus 210 may be inserted within a first and second apertures, as described above with reference to FIG. 9. Alternatively, the first end of a shaft of a massaging member 210 may be inserted into an aperture 212 in the lower edge portion 202*b*5 and the second end of the shaft of the massaging member 210 may be slid in a channel or ramp 214 on the upper edge portion $\mathbf{202}b_4$. FIG. 20 illustrates the second end of the shaft of the massaging member 210 fully inserted and locked into the channel or ramp 214.

When using the single arm full body massaging apparatus 200, a user may grasp both ends of the single arm 202 and apply a massaging member to the body part requiring therapy (the user's own body part or the body part of a different person). The single arm may utilize a base member allowing the single arm to pivot in relation to the surface. Alternatively, the body massaging apparatus 200 may include a separate cradle member (not shown) to be placed on a surface, with the cradle member being configured to receive the single arm when it is placed therein, holding it secure and stable on the surface. This configuration is useful, for example, when the single arms is being used to provide therapy to the underside of a foot. The cradle member allows users to roll the arches of their feet back and forth while they are standing or sitting.

In yet another embodiment any of the massaging members described herein may be removably attached to the second arm 104 of the body massaging apparatus 100. Once removed, the massaging member can be manually rolled over portions of the body requiring therapy but which are otherwise not susceptible to application of the body massaging apparatus either as described in its primary application (e.g., simultaneous use of both arms 102, 104 of the body massaging apparatus 100) or in its secondary application (e.g., use of the second arm 104 only). For example, the second massaging member 134 may be used to massage the area directly behind the ear.

The body massaging apparatus 100 of the present disclosure may be typically used as follows: With the second arm 104 attached to the first arm 102, the base 122 of the apparatus 100 may be placed onto the user's thigh. The user places the wrist and arm to be massaged between the first and second arms 102, 104 at the level of the massaging member 126 and massaging member 134. The user then grabs with the free hand the two upper handles 116, 118 of the arms 12, 104 of the body massaging apparatus 100 and brings them together until the support member 126 and massaging member 134 come into contact with the ailing limb. The arm and wrist can then be moved in either a translating movement perpendicular to the axes of the support member 126 and massaging member 134, or moved in an alternating rotating movement, or a combination of both types of motions. Due to the resilient nature of the massaging member 134, the contact pressure against the ailing limb may be automatically regulated. At all times the user remains in full control of the applied massaging pressure, which can be released instantly upon the user sensing any pain or discomfort. This instant feedback offers a substantial advantage over automatic massaging devices.

In an alternate usage, the second arm 104 of the body massaging apparatus 100 may be separated from the first arm 102 and is used by the user gripping both ends of the second arm 104 and moving the second arm 104 over a body part such as the neck or shoulders. In one embodiment of this usage, the second arm has a handle at either end, making it easier to grip. (See FIGS. 19-20)

In yet another alternate usage, the second arm 104 of the body massaging apparatus 100 may be separated from the first arm 102 and placed in its cradle (not shown) on the floor, and the user steps on the massaging member 134 and moves the foot over it.

In yet another alternate usage, when massaging the legs, the base 122 of the body massaging apparatus 100 may become a handle to support the position and movement of the body massaging apparatus 100 perpendicular to the leg. The user grasps the two handles 116, 118 with the other hand to regulate pressure being applied to the legs.

Figure 21:
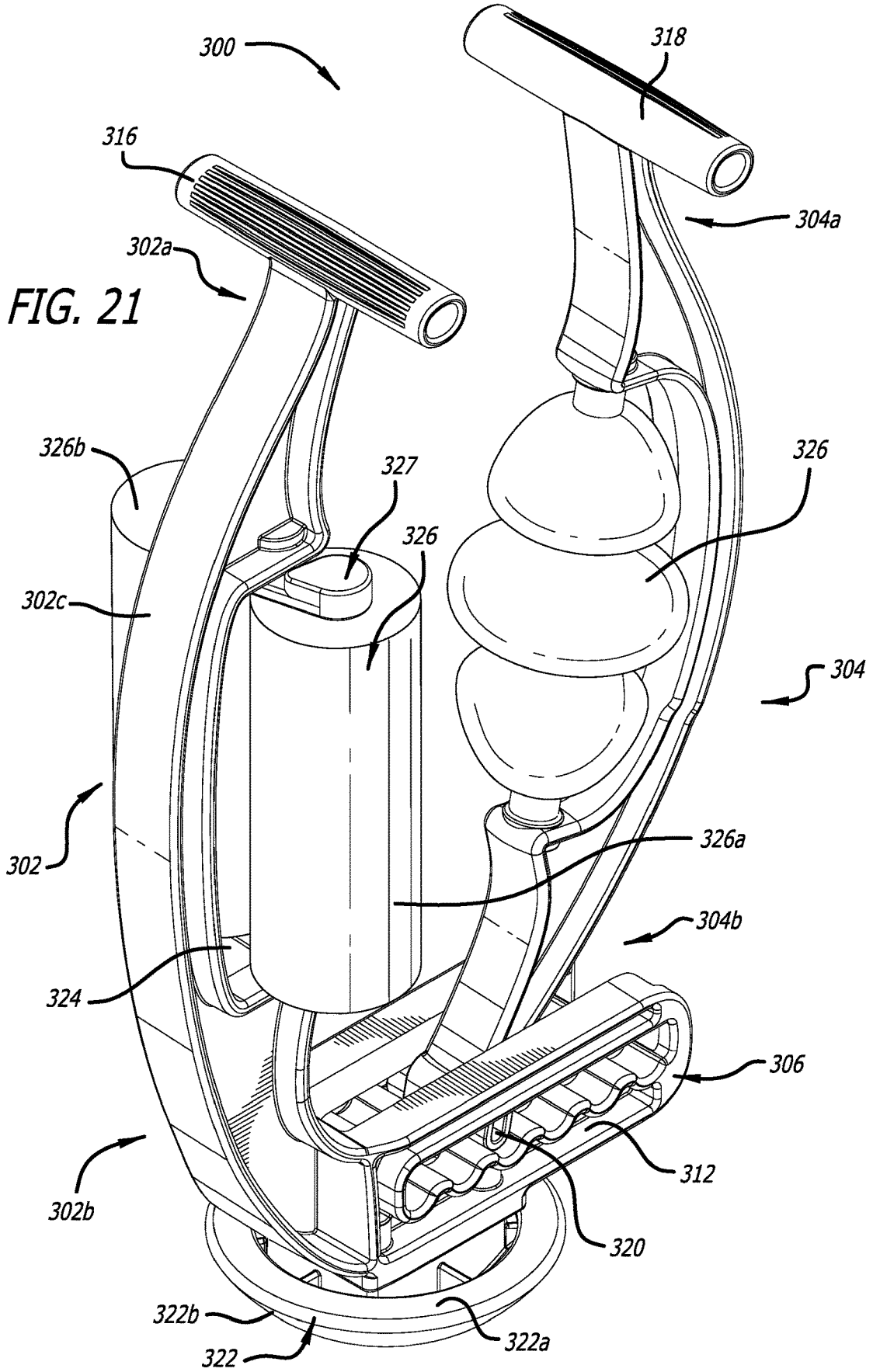
FIG. 21 is a side perspective view of a body massaging apparatus, according to one aspect.
Figure 22:
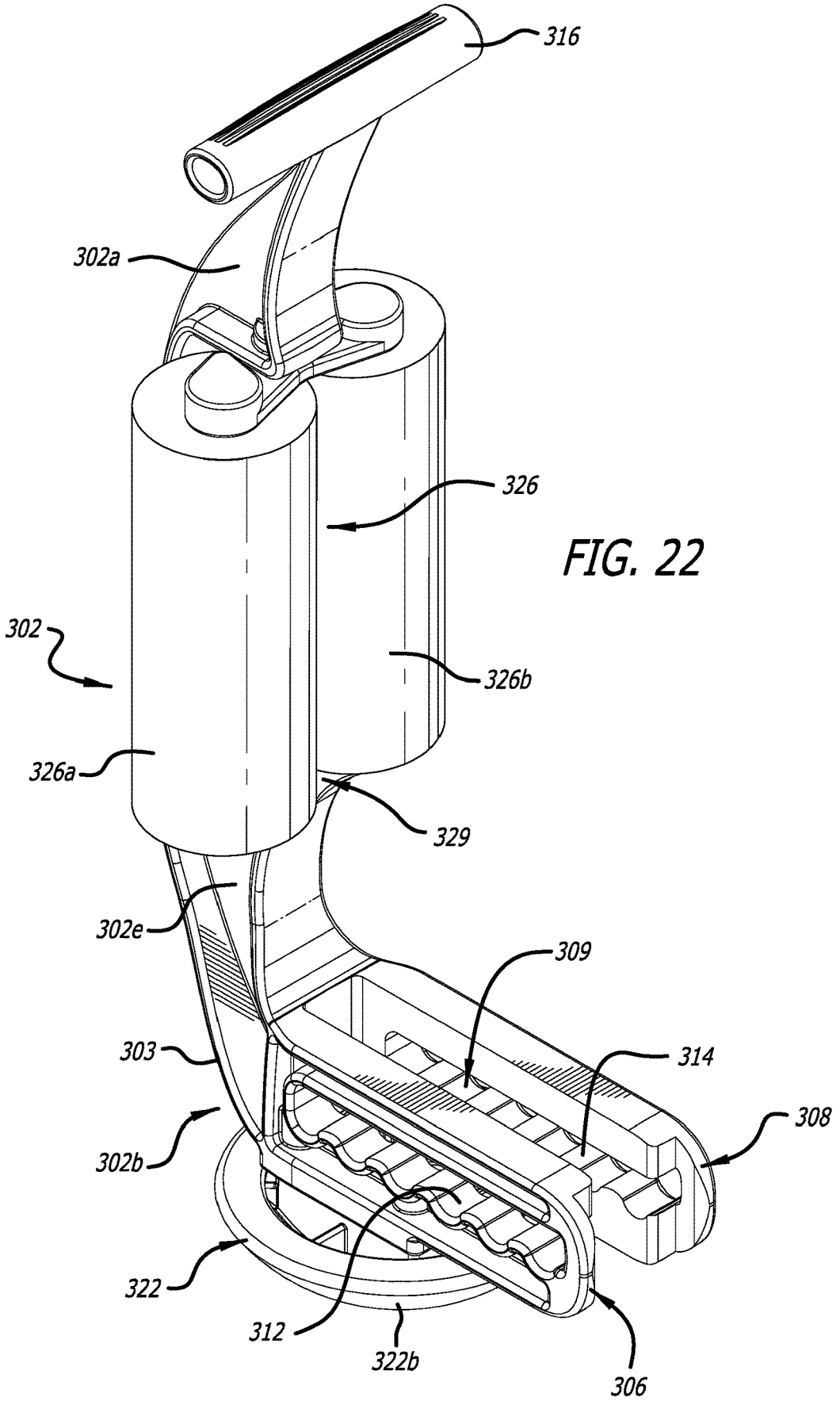
FIG. 22 is a side perspective view of a first arm of the body massaging apparatus of FIG. 21 according to one embodiment.

FIG. 21 is a side perspective view of a body massaging apparatus 300, according to one aspect. FIG. 22 is a side perspective view of a first arm of the body massaging apparatus of FIG. 21.

As shown, the body massaging apparatus 300 may include a first arm 302, having a first arm upper end 302*a* and a first arm lower end 302*b*, and a second arm 304, having a second arm upper end 304*a* and a second arm lower end 304*b*. The first and second arms 302, 304 may be maintained in an adjustable relationship to each other. That is, the first and second arms 302, 304 may be set by the user at various discrete distances from each other to create a desired gap or space between the arms 302, 304 by moving or rotating one or both of the arms along an axis perpendicular to mounting axes of the massaging members. The size of the gap is adjustable so that the gap can be adapted to receive and accommodate a body part to which the body massaging apparatus 300 is being used on. Large gaps being necessary to accommodate larger body parts, such as legs and arms, with smaller gaps being necessary to accommodate smaller body parts, such as fingers. According to one aspect, the second arm 304 may be removable from the first arm 302 and used independently of the apparatus as a whole to massage body parts that otherwise would not fit between the arms 302, 304 of the body massaging apparatus 300.

A first handle 316 may be integrally connected to, and extend perpendicularly outward from, the first arm upper end 302*a* and a second handle 318 may be integrally connected to, and extend perpendicularly outward from, the second arm upper end 304*a*. Although the first and second handles 316, 318 are shown as having elongated tubular configurations, this is by way of example only and the first and second handles 316, 318 may utilize any configuration known in the art and may be solid instead of tubular.

The first arm lower end 302*b* may include a first elongated member 306 integrally connected to, and extending perpendicularly outward from, a first side of the first arm 302 and a second elongated member 308 may be integrally connected to, and extending perpendicularly outward, from a second side of the first arm 302. The first elongated member 306 may be separated from the second elongated member 308 forming a space or channel 309 adapted or configured to receive the second arm lower end 304*b* of the second arm 304.

Each of the first and second elongated members 306, 308 may have a generally rectangular configuration and include a slotted guideway 312 and 314, respectively, having corresponding discrete pairs of depressions along its length. The depressions may be adapted or configured to receive and engage with a securing member 320 located on the second arm lower end 304*b* allowing the second arm 104 to rotate relative to the first arm 302 and along an axis perpendicular to the mounting axes of massaging members, described below.

The securing member 320 may be integrally connected to the second arm lower end 304*b* and adapted to be received within the slotted guideways 312, 314 of the first elongated member 306 and the second elongated member 308 each having a plurality of depressions. For example, the securing member 320 may be inserted into the slotted guideways 312, 314 of the first and second elongated members 306, 308 of the first arm 302 and then aligned with one of the pairs of depressions (that is a depression from each of the slotted guideways 312, 314) to achieve a desired relative positioning of the first and second arms 302, 304. Next, the second arm 304 may be pivoted into a substantially parallel orientation to the first arm 302, causing the securing member 320 to engage with a pair of depressions and maintain the spacing of the arms 302, 304 as desired. As described above, a user may place a body part between the two arms of the apparatus to be acted upon by massaging members secured to medial portions of each of the arms, whereby the body part is adjustably clamped between the pair of massaging members and massaged by translating and rotating movements of the body part along an axis perpendicular to the mounting axes of the massaging members.

According to one aspect, a base 322 may be connected, either fixedly or removably, to the bottom surfaces of the slotted guideways 312 and 314 at the first arm lower end 302*b*. The base 322 may have a substantially planar upper portion 322*a* and a lower portion 322*b* have a generally circular or rounded configuration, such as a portion of a sphere. The lower portion 322*b* of the base 322 may be made of, or covered with, a high-stick, non-skid material, so that the body massaging apparatus 300, when placed on a surface, remains substantially in place during use. The rounded shape of the lower portion 322*b* of the base 322 (when in contact with a surface or other object) allows the body massaging apparatus 300 to be pivoted in relation to the surface in order to precisely orient the body massaging apparatus 300 at any desired angle. The surface upon which the base 322 may be placed, for example, include a table top, the floor, the thigh or other body part of a user, a wall, or any other suitable surface. The base 322 of the body massaging apparatus 300 may also be used as a handle to support the position and movement of the body massaging apparatus 300, for example, when the body massaging apparatus 300 is used on a leg (rather than moving the leg through a stationary device, the body massaging apparatus 300 is moved over the stationary leg). In this example, the user's other hand grasps the first and second handles 316, 318 to regulate pressure being applied to the leg.

The first arm 302 may have an outer surface 302*c* and an inner surface 302*d* separated by and integrally connected, to an inner wall 302*e* of the first arm 302. According to one aspect, the thickness of the inner wall 302*e* may be smaller than the widths of the outer and inner surfaces 302*c*, 302*d* forming a ridge or lip 303 allowing for a user to easily grasp the first arm 302. The inner surface 302*d* may have a first opening or cavity 324 adapted or configured to receive a first massaging member 326. According to one example, the outer surface 302*c* of the first arm 302 may have a generally continuous arcuate shape. The inner surface 302*d* of the first arm 302 is the same as the inner surface 102*d* of the first arm 102 shown in FIG. 8. The structure of the first arm 302 as shown in FIGS. 21-22 has the same structure as the first arm 102 in FIG. 8. For convenience and clarity, the inner surface of the first arm 302 will be described with reference to the inner surface of the first arm 102 in FIG. 8. The inner surface 302*d* may include an upper portion $\mathbf{102}d_1$, a medial portion $\mathbf{102}d_2$ and a lower portion $\mathbf{102}d_3$ where the medial portion $\mathbf{102}d_2$ is integrally connected between the upper portion $\mathbf{102}d_1$ and the lower portion $\mathbf{102}d_3$. The medial portion $\mathbf{102}d_2$ may be connected to the upper portion $\mathbf{102}d_1$ by an upper edge portion $\mathbf{102}d_4$ and the lower portion $\mathbf{102}d_3$ by a lower edge portion $\mathbf{102}d_5$. According to one example, the upper edge portion $\mathbf{102}d_4$ and the lower edge portion $\mathbf{102}d_5$ may extend substantially perpendicularly outward from the upper and lower ends of the medial portion 102$d_2$, respectively, creating or forming the first cavity 124 (reference number 324 in FIG. 21) in the first arm 302. Although all portions 102$d_1$-102$d_3$ are shown having an arcuate shape, this is by way of example only. The upper portion 102$d_1$ and the lower portion 102$d_3$ are located within a first vertical plane and the medial portion 102$d_2$ is located within a second vertical plane where the first vertical plane is different than the second vertical plane.

According to one aspect, the upper edge portion 102$d_4$ of the inner surface 102*d* of the first arm 302 may include a first aperture 128*a* and the lower edge portion 102$d_5$ of the inner surface 102*d* of the first arm 302 may include a second aperture 128*b*. As explained in further detail below, the first and second apertures are adapted or configured to receive shafts on the first massaging member 326 to retain the first massaging member 326 to the first arm 302. The first massaging member 326 may include a first elongated roller 326*a* and a second elongated roller 326*b* secured or mounted between an upper plate member 327 and a lower plate member 329. The upper and lower plate members 327, 329 may have the same configuration.

The upper plate member 327 may include a first surface 327*a* and an opposing second surface 327*b*, a first side portion 327*c* and a second side portion 327*d* integrally connected to a middle portion 327*e*. When in an initial position, the first and second side portions 327*c*, 327*d* are located in first vertical plane and the middle portion is located in a second vertical plane where the first and second vertical planes are different. The upper plate member 327 may be rotatably secured to upper edge portion 102$d_4$ of the inner surface 102*d* of the first arm 302 by a substantially rigid shaft 330 extending perpendicularly outward from the middle portion 327*e* and adapted or configured to be received within the first aperture in the upper edge portion 102$d_4$ of the inner surface 102*d* of the first arm 302. The first surface 327*a* of the upper plate member 327*a* may include a first stop member 332 located on the first side portion 327*c* and a second stop member 334 located on the second side portion 327*d*. The upper plate member 327 in FIG. 25 includes a first outer surface 327*f* which extends inwardly and a second outer surface 327*g*, opposing the first outer surface 327*g*, which extend outwardly forming an arcuate shape.

Figure 23:
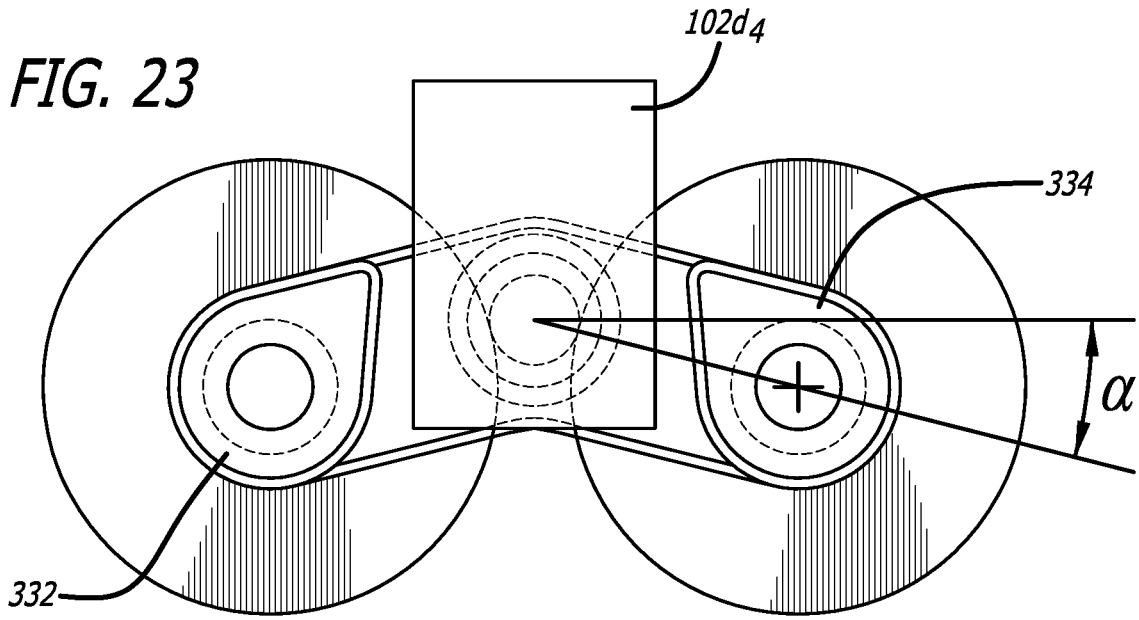
FIG. 23 is a top plan view of a plate member in the body massaging apparatus of FIG. 20 in an initial position.
Figure 24:
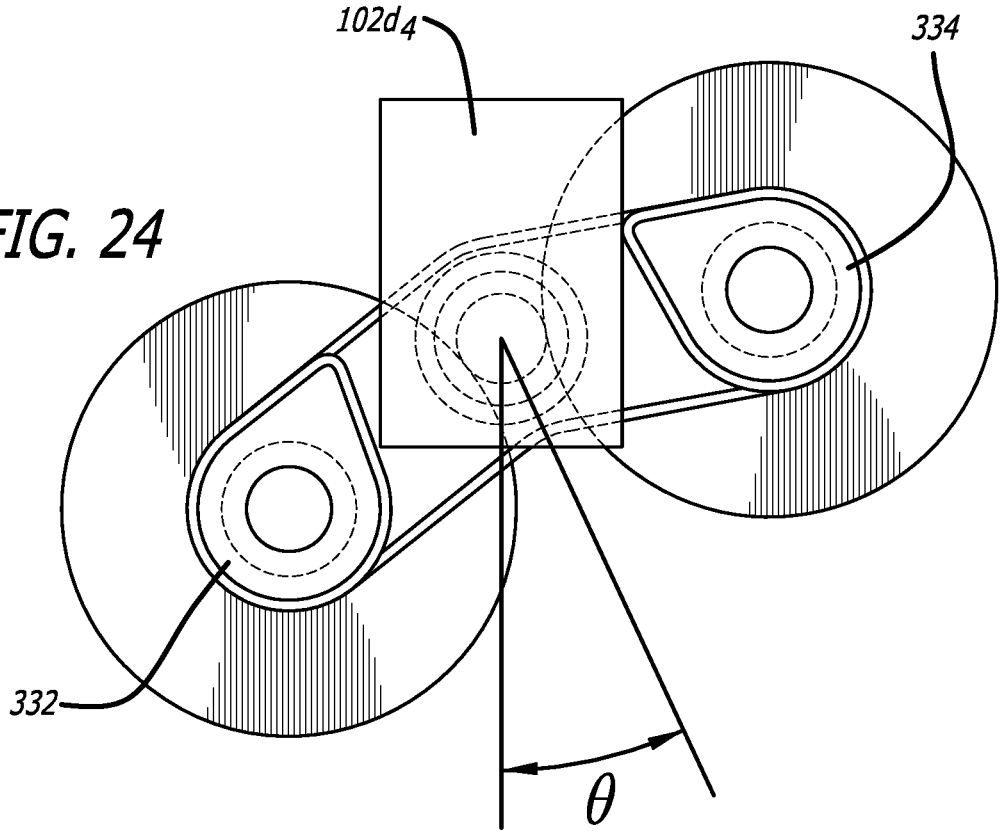
FIG. 24 is a top plan view of a plate member in the body massaging apparatus of FIG. 20 in a rotated position.

As shown in FIGS. 23 and 24, the first and second stop members 332, 334 allow the upper plate member 327 to rotate within a first angle α (FIG. 23) or a second angle θ (FIG. 24).

According to one aspect, the upper plate member 327 may be rotated by a first angle α which may be 7 degrees. In one example, the angle of rotation α may be between 0 degrees and 7 degrees. In other examples, α may be greater than 7 degrees. According to one embodiment, the first and second stop members 332, 334 may have a generally teardrop shaped configuration having a globular form at the bottom tapering to a point at the top. The point at the top of each of the stop members is utilized to maintain the angle of rotation of the massaging member 326. When the point at the top of one of the stop member engages the upper edge portion 102$d_4$ of the first arm 302, the massaging member 326 is unable to rotate further in that direction. The upper plate 327 may be located in an initial position as shown in FIG. 23 where the angle of rotation is 0 degrees, or the upper plate 327 may rotate between a first position and a second position, where the first position is located α degrees (e.g. 7 degrees) to the right and the second position is located α (e.g. 7 degrees) to the left. Consequently, the range of motion of the upper plate member 327 is 2α (e.g. 7 degrees total).

According to another aspect, the upper plate member 327 may be rotated by a second angle θ which may be 25 degrees. In one example, the angle of rotation may be between 0 degrees and 25 degrees. In other examples, θ may be greater than 25 degrees. According to one embodiment, the first and second stop members 332, 334 may have a generally teardrop shaped configuration having a globular form at the bottom tapering to a point at the top. The point at the top of each of the stop members is utilized to maintain the angle of rotation of the massaging member 326. When the point at the top of one of the stop member engages the upper edge portion 102$d_4$ of the first arm 302, the massaging member 326 is unable to rotate further in that direction. The upper plate 327 may be located in an initial position as shown in FIG. 23 where the angle of rotation is 0 degrees, or the upper plate 327 may rotate between a first position and a second position, where the first position is located θ degrees (e.g. 25 degrees) to the right and the second position is located θ (e.g. 25 degrees) to the left (See FIG. 24). Consequently, the range of motion of the upper plate member 327 is 2θ (e.g. 50 degrees total).

The first and second angles α and θ discussed above are by way of example only and the range of motion of the upper plate member 327 may be more or less.

The upper plate member 327 may further include a first opening 336 extending through the first side portion 327*c* including the first stop member 332 and a second opening 338 extending through the second side portion 327*d* including the second stop member 334. The first and second openings 336 and 338 are adapted to receive shafts (not shown) extending outwardly from the first and second rollers 326*a*, 326*b* securing the rollers to the upper plate member 327.

Correspondingly, the lower plate member 329 may include a first surface 329*a* and an opposing second surface 329*b*, a first side portion 329*c* and a second side portion 329*d* integrally connected to a middle portion 329*e*. When in an initial position, the first and second side portions 329*a*, 329*b* are located in first vertical plane and the middle portion is located in a second vertical plane where the first and second vertical planes are different. The lower plate member 329 may be rotatably secured to lower edge portion 102$d_5$ of the inner surface 102*d* of the first arm 302 by a substantially rigid shaft (not shown) extending perpendicularly outward from the middle portion 329*c* and adapted or configured to be received within the second aperture in the lower edge portion 102$d_5$ of the inner surface 102*d* of the first arm 302. As the lower plate member 329 has the same configuration as the upper plate member 327, it should be noted that the details of the upper plate member 327 described above and shown in FIGS. 23-26 are applicable to the lower plate member 329. For example, the lower plate member 327 may be rotated within a first angle α (FIG. 23) or a second angle θ (FIG. 24).

In one example, the upper and lower plate members 327, 329 may have a slightly curved or arcuate configuration.

In one example, the upper plate member 327 moves in conjunction with of the lower plate member 329 allowing the user to change a tilt of each of the rollers 326*a*, 326*b*. When in an initial position, each of the rollers are located perpendicularly to the first and second elongated members 306, 308. However, by moving the upper plate member 327 and/or lower plate member 329, each of the rollers may tilt forward or backwards by α or θ degrees, as described above.

According to one example, the first and second elongated rollers 326*a*, 326*b* of the massaging member 326 may be made from a supportive sponge-like foam material or any other type of material known in the art, such as rubber or plastic. Each of the elongated rollers 326*a*, 326*b* include an elongated shaft extending through the entire vertical length of the rollers 326*a*, 326*b* where the elongated shaft is longer then the rollers 326*a*, 326*b* such that a first shaft portion extends outwardly from a top end of the rollers and a second shaft portion extends outwardly from a bottom end of the rollers. These shafts may then be received in the openings of the upper and lower plate members as described above. Alternatively, each roller 326*a*, 326*b* may include separate shafts on each end instead of one elongated shaft extending through the entire vertical length of the rollers. For example, the first elongated roller 326*a* may include a first upper shaft extending outwardly from the top end of the first elongated roller 326*a* and a first lower shaft extending outwardly from bottom end of the first elongated roller 326*a*. Conversely, the second elongated roller 326*b* may include a first upper shaft extending outwardly from the top end of the first elongated roller 326*a* and a first lower shaft extending outwardly from bottom end of the first elongated roller 326*b*.

According to one embodiment, the second arm 304 may be adapted to receive a second massaging member 334 which may remain in a fixed stationary (i.e. not rotatable) position. One example of the second massaging member 334 may be a multi-curved contoured roller may be made from any type of material known in the art including a resilient material such as foam or rubber. The unique shape of the multi-curved contoured roller is designed to properly perform various desired therapy techniques as is known in the art. According to one example, the second massaging member 334 "gives" (e.g., is resilient and flexible) to absorb the necessary flex when under use. It also has specifically designed curves to give the necessary intensity on particular spots so effective therapy can be performed.

When the first and second arms 302, 304 of the body massaging apparatus 310 are used together, a user may place or insert a body part between them allowing the user to perform various different desired therapy techniques known in the art.

Figure 27:
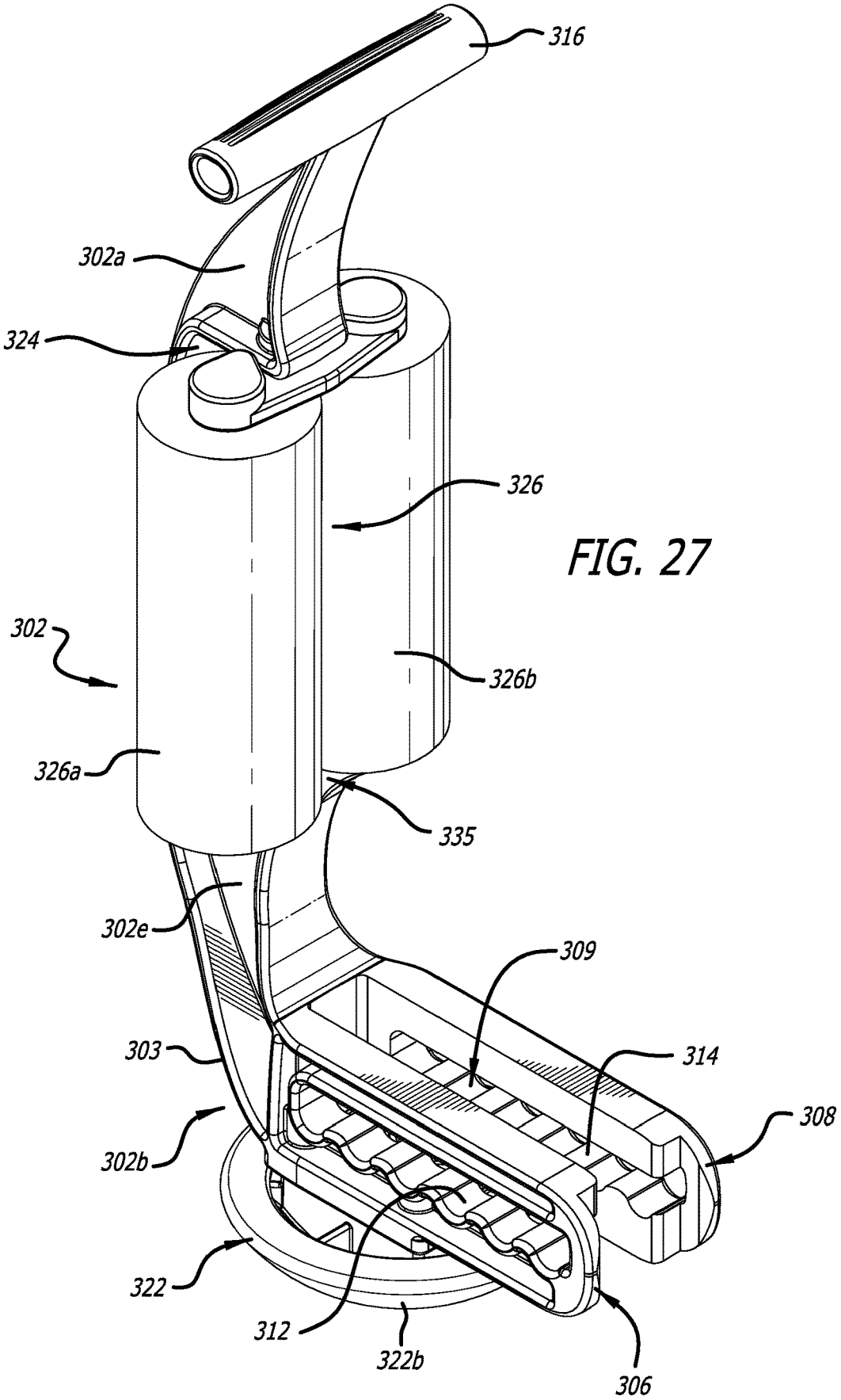
FIG. 27 is an alternate embodiment of a side perspective view of a first arm of a body massaging apparatus.

FIG. 27 is an alternate embodiment of a side perspective view of a first arm 302 that may be used with the body massaging apparatus of FIG. 21. As shown, the first arm 302 may include a first arm upper end 302*a*. As with the embodiment in FIG. 21, the alternative embodiment of the first arm 302 in FIG. 27 may be maintained in an adjustable relationship with the second arm 304 (See FIG. 21). That is, the first and second arms 302, 304 may be set by the user at various discrete distances from each other to create a desired gap or space between the arms 302, 304 by moving or rotating one or both of the arms along an axis perpendicular to mounting axes of the massaging members. The size of the gap is adjustable so that the gap can be adapted to receive and accommodate a body part to which the body massaging apparatus 300 is being used on. Large gaps being necessary to accommodate larger body parts, such as legs and arms, with smaller gaps being necessary to accommodate smaller body parts, such as fingers. According to one aspect, the second arm 304 may be removable from the first arm 302 and used independently of the apparatus as a whole (indicated in FIG. 27 by arrow 335) to massage body parts that otherwise would not fit between the arms 302, 304 of the body massaging apparatus 300.

The first arm 302 includes a first handle 316 integrally connected to, and extending perpendicularly outward from, the first arm upper end 302*a*. Although the first handle 316 is shown as having elongated tubular configurations, this is by way of example only and the first handle 316 may utilize any configuration known in the art and may be solid instead of tubular.

The first arm lower end 302*b* may include a first elongated member 306 integrally connected to, and extending perpendicularly outward from, a first side of the first arm 302 and a second elongated member 308 may be integrally connected to, and extending perpendicularly outward, from a second side of the first arm 302. The first elongated member 306 may be separated from the second elongated member 308 forming a space or channel 309 adapted or configured to receive the second arm lower end 304*b* of the second arm 304.

Each of the first and second elongated members 306, 308 may have a generally rectangular configuration and include a slotted guideway 312 and 314, respectively, having corresponding discrete pairs of depressions along its length. The depressions may be adapted or configured to receive and engage with a securing member 320 located on the second arm lower end 304*b* allowing the second arm 304 (See FIG. 21 above for the second arm 304) to rotate relative to the first arm 302 and along an axis perpendicular to the mounting axes of massaging members, described below.

As described above with respect to FIG. 21 with respect to the second arm 304, the securing member 320 may be integrally connected to the second arm lower end 304*b* and adapted to be received within the slotted guideways 312, 314 of the first elongated member 306 and the second elongated member 308 each having a plurality of depressions. For example, the securing member 320 may be inserted into the slotted guideways 312, 314 of the first and second elongated members 306, 308 of the first arm 302 and then aligned with one of the pairs of depressions (that is a depression from each of the slotted guideways 312, 314) to achieve a desired relative positioning of the first and second arms 302, 304. Next, the second arm 304 may be pivoted into a substantially parallel orientation to the first arm 302, causing the securing member 320 to engage with a pair of depressions and maintain the spacing of the arms 302, 304 as desired. As described above, a user may place a body part between the two arms of the apparatus to be acted upon by massaging members secured to medial portions of each of the arms, whereby the body part is adjustably clamped between the pair of massaging members and massaged by translating and rotating movements of the body part along an axis perpendicular to the mounting axes of the massaging members.

According to one aspect, a base 322 may be connected, either fixedly or removably, to the bottom surfaces of the slotted guideways 312 and 314 at the first arm lower end 302*b*. The base 322 may have a substantially planar upper portion 322*a* and a lower portion 322*b* have a generally circular or rounded configuration, such as a portion of a sphere. The lower portion 322*b* of the base 322 may be made of, or covered with, a high-stick, non-skid material, so that the body massaging apparatus 300, when placed on a surface, remains substantially in place during use. The rounded shape of the lower portion 322*b* of the base 322 (when in contact with a surface or other object) allows the body massaging apparatus 300 to be pivoted in relation to the surface in order to precisely orient the body massaging apparatus 300 at any desired angle. The surface upon which the base 322 may be placed, for example, include a table top, the floor, the thigh or other body part of a user, a wall, or any other suitable surface. The base 322 of the body massaging apparatus 300 may also be used as a handle to support the position and movement of the body massaging apparatus 300, for example, when the body massaging apparatus 300 is used on a leg (rather than moving the leg through a stationary device, the body massaging apparatus 300 is moved over the stationary leg). In this example, the user's other hand grasps the first and second handles 316, 318 to regulate pressure being applied to the leg.

The first arm 302 may have an outer surface 302*c* and an inner surface 302*d* separated by and integrally connected, to an inner wall 302*e* of the first arm 302. According to one aspect, the thickness of the inner wall 302*e* may be smaller than the widths of the outer and inner surfaces 302*c*, 302*d* forming a ridge or lip 303 allowing for a user to easily grasp the first arm 302. The inner surface 302*d* may have a first opening or cavity 324 adapted or configured to receive a first massaging member 326. According to one example, the outer surface 302*c* of the first arm 302 may have a generally continuous arcuate shape. The inner surface 302*d* of the first arm 302 is the same as the inner surface 102*d* of the first arm 102 shown in FIG. 8. The structure of the first arm 302 as shown in FIG. 27 has the same structure as the first arm 102 in FIG. 8. For convenience and clarity, the inner surface of the first arm 302 will be described with reference to the inner surface of the first arm 102 in FIG. 8. The inner surface 302*d* may include an upper portion $\mathbf{102}d_1$, a medial portion $\mathbf{102}d_2$ and a lower portion $\mathbf{102}d_3$ where the medial portion $\mathbf{102}d_2$ is integrally connected between the upper portion $\mathbf{102}d_1$ and the lower portion $\mathbf{102}d_3$. The medial portion $\mathbf{102}d_2$ may be connected to the upper portion $\mathbf{102}d_1$ by an upper edge portion $\mathbf{102}d_4$ and the lower portion $\mathbf{102}d_3$ by a lower edge portion $\mathbf{102}d_5$. According to one example, the upper edge portion $\mathbf{102}d_4$ and the lower edge portion $\mathbf{102}d_5$ may extend substantially perpendicularly outward from the upper and lower ends of the medial portion $\mathbf{102}d_2$, respectively, creating or forming the first cavity 124 (reference number 324 in FIG. 27) in the first arm 302. Although all portions $\mathbf{102}d_1$-$\mathbf{102}d_3$ are shown having an arcuate shape, this is by way of example only. The upper portion $\mathbf{102}d_1$ and the lower portion $\mathbf{102}d_3$ are located within a first vertical plane and the medial portion $\mathbf{102}d_2$ is located within a second vertical plane where the first vertical plane is different than the second vertical plane.

Figure 28:
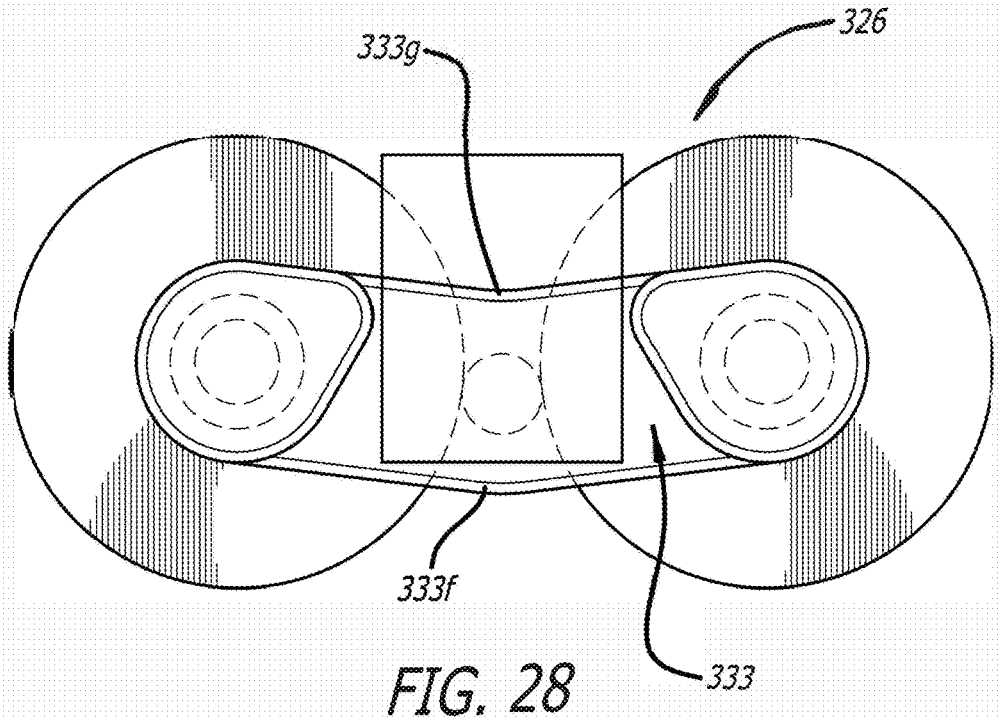
FIG. 28 is a top plan view of an upper plate member secured to a first massaging member, the upper plate member located in an initial position.
Figure 29:
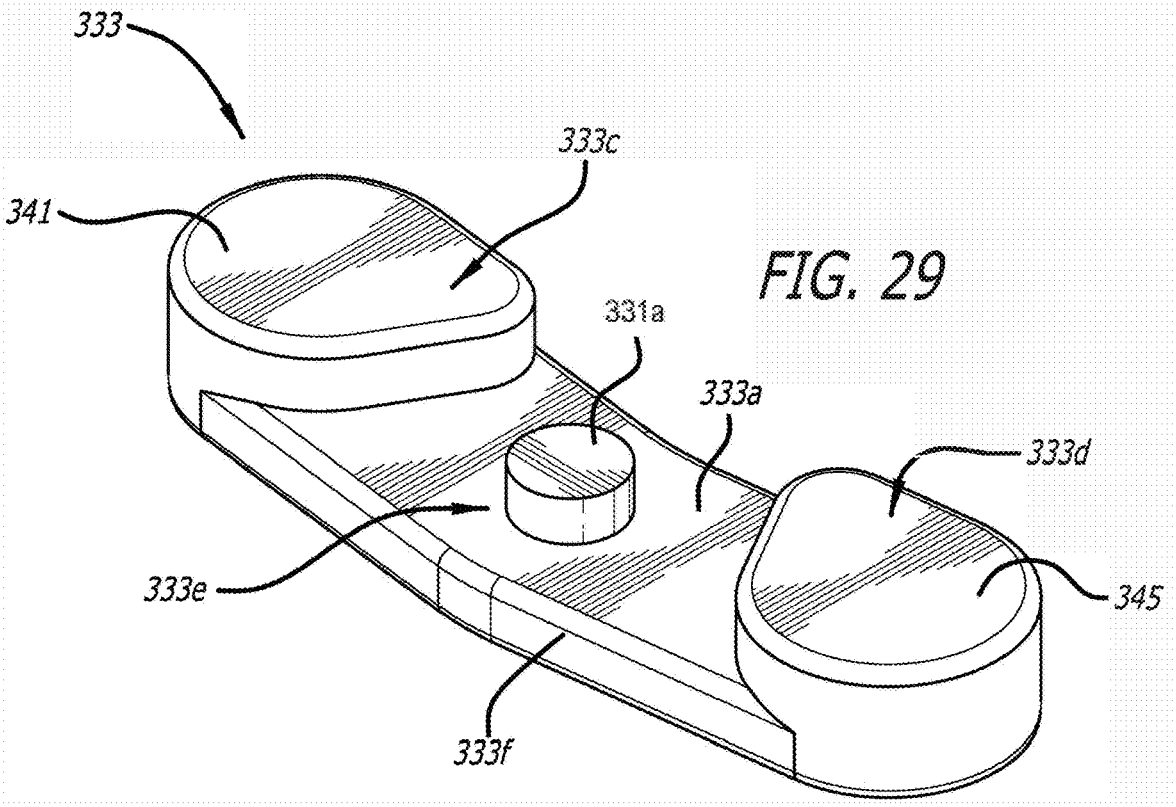
FIG. 29 is a top left perspective view a plate member according to one embodiment.

According to one aspect, the upper edge portion $\mathbf{102}d_4$ of the inner surface 102*d* of the first arm 302 may include a first aperture 128*a* and the lower edge portion $\mathbf{102}d_5$ of the inner surface 102*d* of the first arm 302 may include a second aperture 128*b*. As explained in further detail below, the first and second apertures are adapted or configured to receive shafts on the first massaging member 326 to retain the first massaging member 326 to the first arm 302. The first massaging member 326 may include a first elongated roller 326*a* and a second elongated roller 326*b* secured or mounted between an upper plate member 333 and a lower plate member 329. The upper and lower plate members 333, 329 may have the same configuration. FIG. 28 is a top plan view of the upper plate member 333, according to another aspect, secured to the first massaging member 326, the upper plate member 333 located in an initial position. FIG. 29 is a top left perspective view of the upper plate member 333 of FIG. 28.

The upper plate member 333 may include a first surface 333*a*, and an opposing second surface 333*b* (not shown), a first side portion 333*c* and a second side portion 333*d* integrally connected to a middle portion 333*e*. When in an initial position (See FIG. 28), the first and second side portions 333*c*, 333*d* are located in first vertical plane and the middle portion is located in a second vertical plane where the first and second vertical planes are different. The upper plate member 333 may be rotatably secured to upper edge portion $\mathbf{102}d_4$ of the inner surface 102*d* of the first arm 302 by a substantially rigid shaft 330*a* extending perpendicularly outward from the middle portion 333*e* and adapted or configured to be received within the first aperture in the upper edge portion $\mathbf{102}d_4$ of the inner surface 102*d* of the first arm 302. The first surface 333*a* of the upper plate member 333 may include a first stop member 341 located on the first side portion 333*c* and a second stop member 345 located on the second side portion 333*d*. Similarly to FIGS. 23 and 24, the first and second stop members 341, 344 allow the upper plate member 333 to rotate within a first angle $\alpha$ or a second angle $\theta$.

Figure 25:
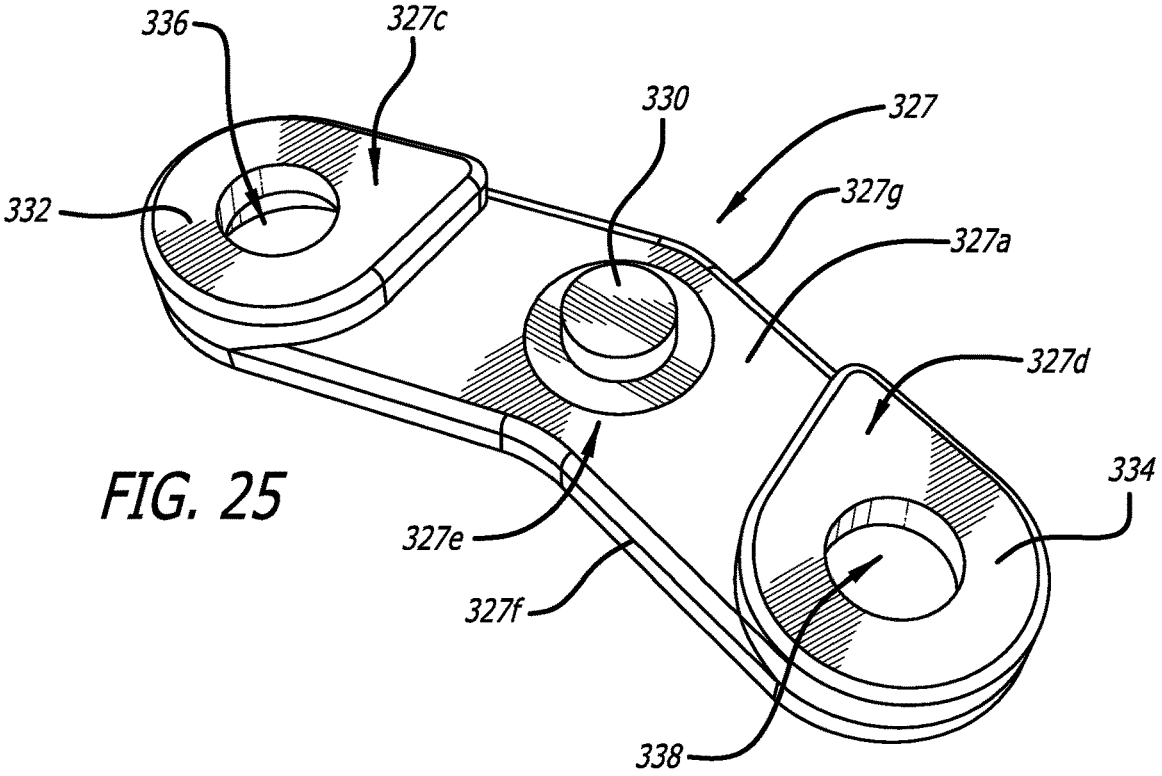
FIG. 25 is a top right perspective view of a plate member in the body massaging apparatus of FIG. 20.
Figure 26:
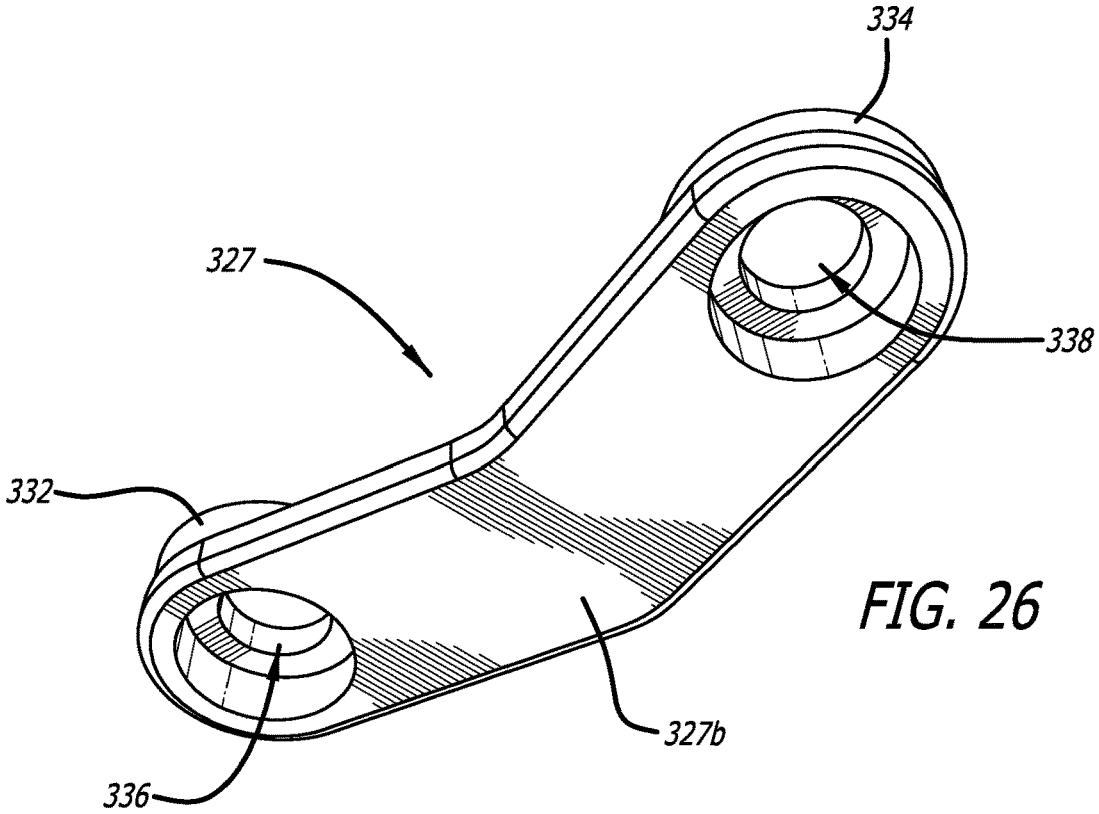
FIG. 26 is a bottom left perspective view of a plate member in the body massaging apparatus of FIG. 20.

Unlike the upper plate member 327 in FIG. 25, a first outer surface 333*f* of the upper plate member (See FIG. 29) extends outwardly and a second outer surface 333*g*, opposing the first outer surface 333*f* forming an arcuate shape. According to one embodiment, the upper plate member may rotate by a first angle $\alpha$ (similar to the upper plate member 327 in FIG. 23) or the upper plate member may rotate by a second angle $\theta$ degrees, similar to the upper plate member 327 in FIG. 24.

According to one aspect, the upper plate member 333 may be rotated by a first angle $\alpha$ which may be 7 degrees. In one example, the angle of rotation $\alpha$ may be between 0 degrees and 7 degrees. In other examples, $\alpha$ may be greater than 7 degrees. According to one embodiment, the first and second stop members 341, 345 may have a generally teardrop shaped configuration having a globular form at the bottom tapering to a point at the top. The point at the top of each of the stop members is utilized to maintain the angle of rotation of the massaging member 326. When the point at the top of one of the stop members engages the upper edge portion $\mathbf{102}d_4$ of the first arm 302, the massaging member 326 is unable to rotate further in that direction. The upper plate 333 may be located in an initial position as shown in FIG. 28 where the angle of rotation is 0 degrees, or the upper plate 333 may rotate between a first position and a second position, where the first position is located $\alpha$ degrees (e.g. 7 degrees) to the right and the second position is located $\alpha$ (e.g. 7 degrees) to the left. Consequently, the range of motion of the upper plate member 333 is $2\alpha$ (e.g. 7 degrees total).

According to another aspect, the upper plate member 333 may be rotated by a second angle $\theta$ which may be 25 degrees. In one example, the angle of rotation $\theta$ may be between 0 degrees and 25 degrees. In other examples, $\theta$ may be greater than 25 degrees. According to one embodiment, the first and second stop members 341, 345 may have a generally teardrop shaped configuration having a globular form at the bottom tapering to a point at the top. The point at the top of each of the stop members is utilized to maintain the angle of rotation of the massaging member 326. When the point at the top of one of the stop members engages the upper edge portion $\mathbf{102}d_4$ of the first arm 302, the massaging member 326 is unable to rotate further in that direction. The upper plate 333 may be located in an initial position as shown in FIG. 28 where the angle of rotation is 0 degrees, or the upper plate 333 may rotate between a first position and a second position, where the first position is located $\theta$ degrees (e.g. 25 degrees) to the right and the second position is located $\theta$ (e.g. 25 degrees) to the left. Consequently, the range of motion (or rotation) of the upper plate member 333 is $2\theta$ (e.g. 50 degrees total).

The first and second angles α and θ discussed above are by way of example only and the range of motion of the upper plate member 333 may be more or less.

Dual Roller Mechanism

Figure 30:
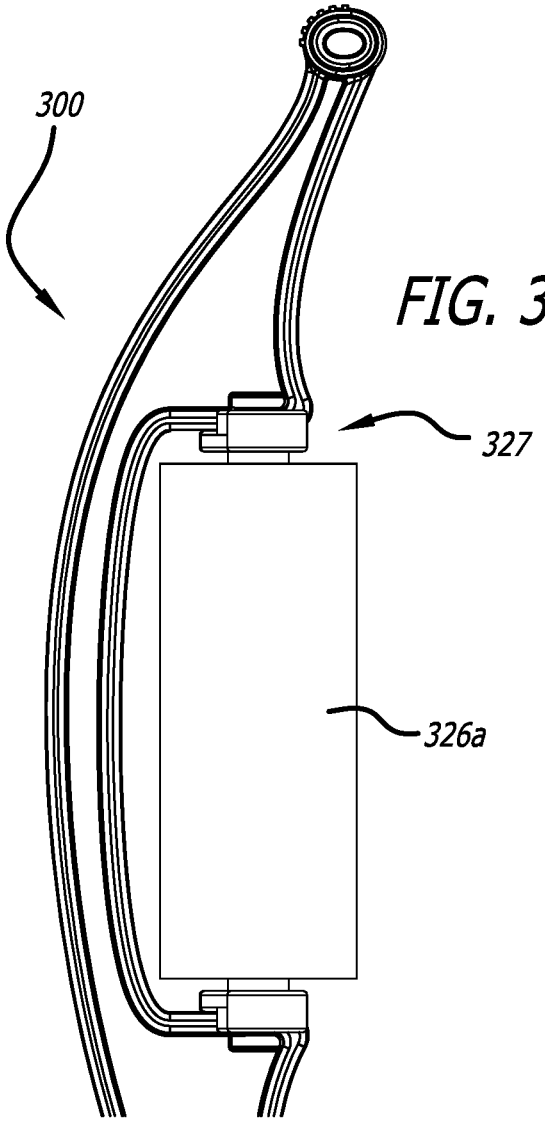
FIG. 30 is a partial side view of a dual roller mechanism in body massaging apparatus, according to one aspect.
Figure 31:
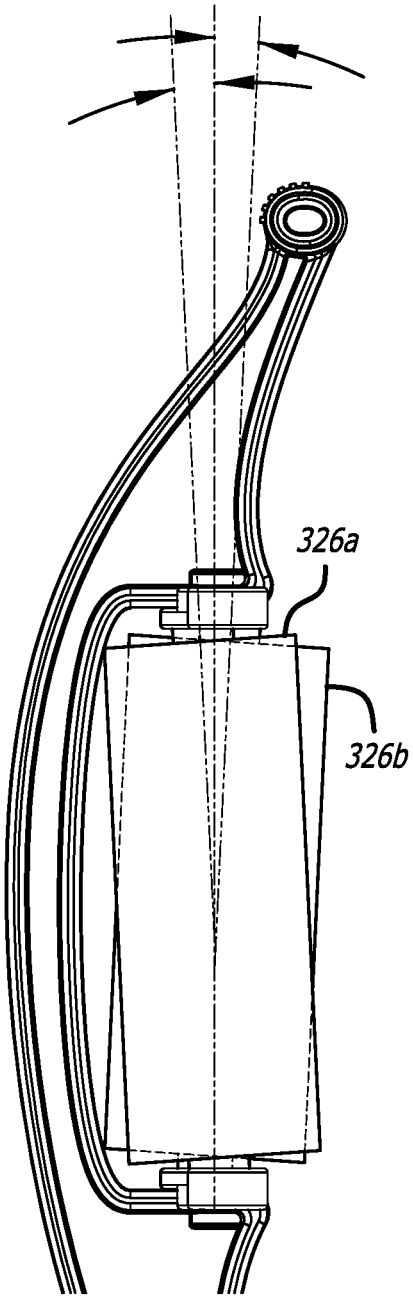
FIG. 31 illustrates pivoting of the rollers in the dual roller mechanism in the body massaging apparatus of FIG. 30.
Figure 32:
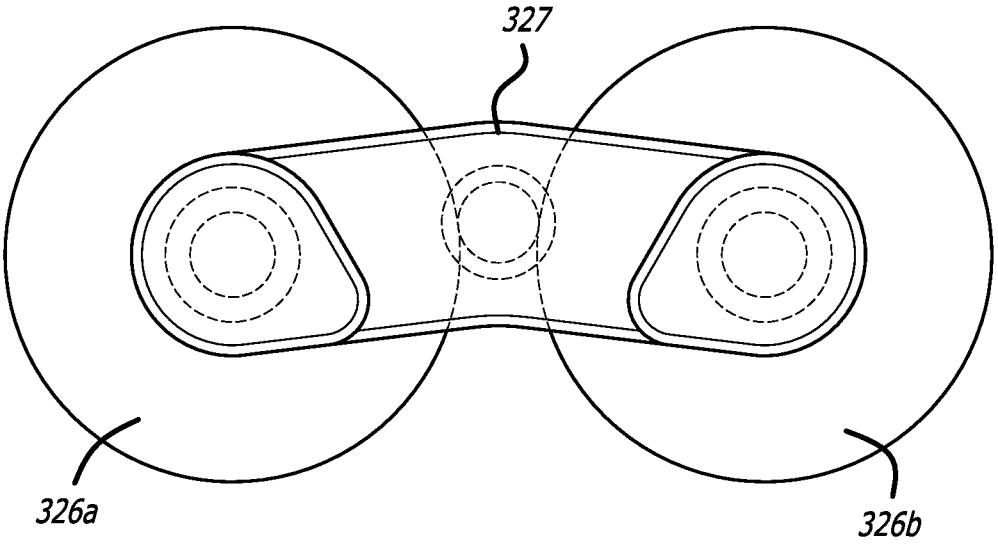
FIG. 32 is a top plan view of a plate member the body massaging apparatus of FIG. 30 showing the rollers in the dual roller mechanism in a first position.
Figure 33:
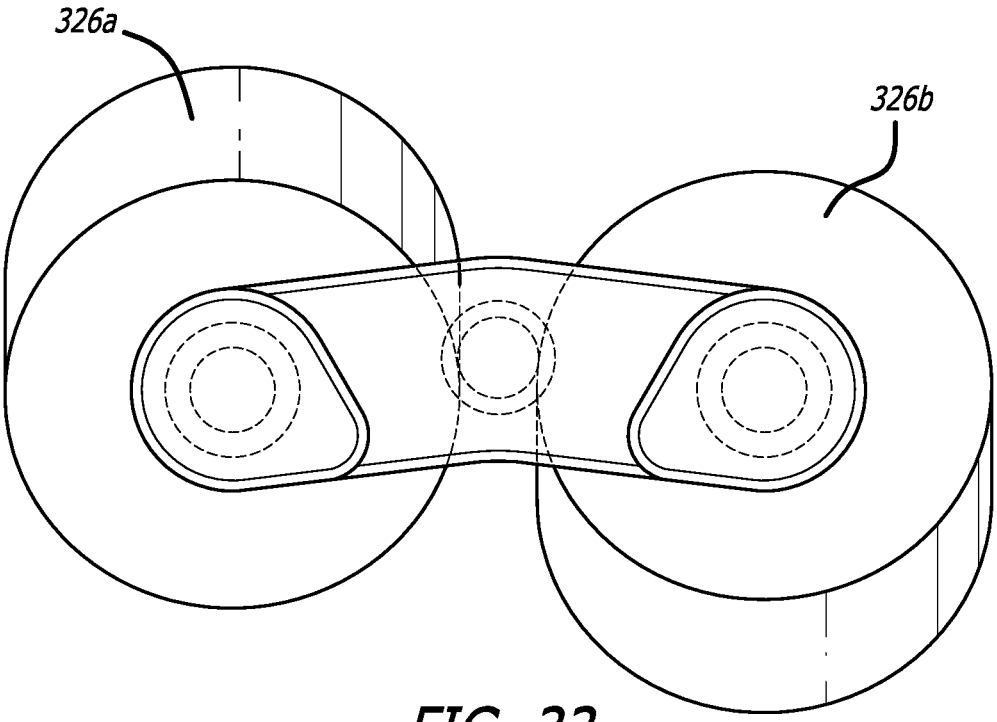
FIG. 33 is a top plan view of the plate member of FIG. 32 showing each roller in the dual roller mechanism tilted in a second position.
Figure 34:
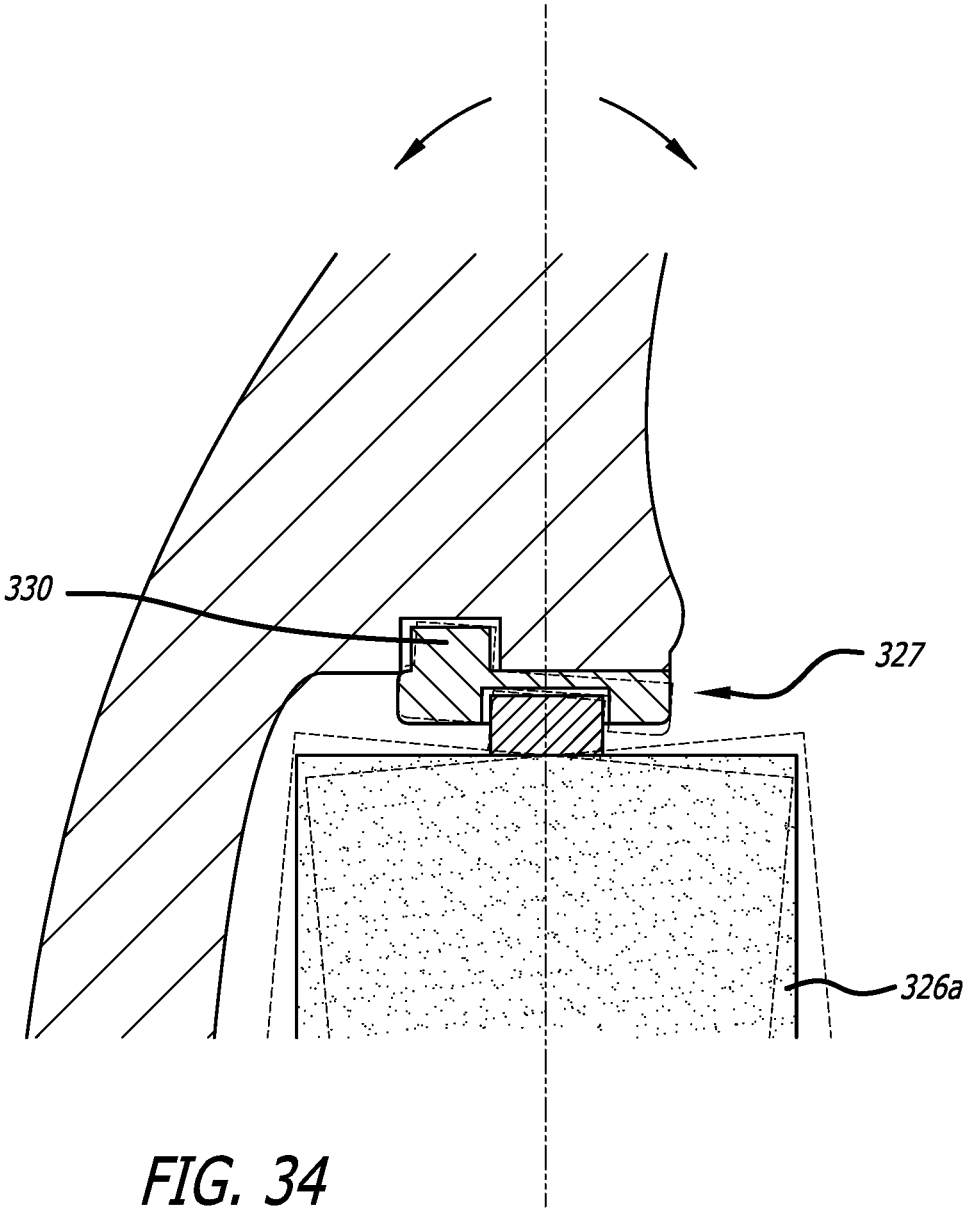
FIG. 34 is a partial side of the view of the dual roller mechanism of FIG. 30.
Figure 35:
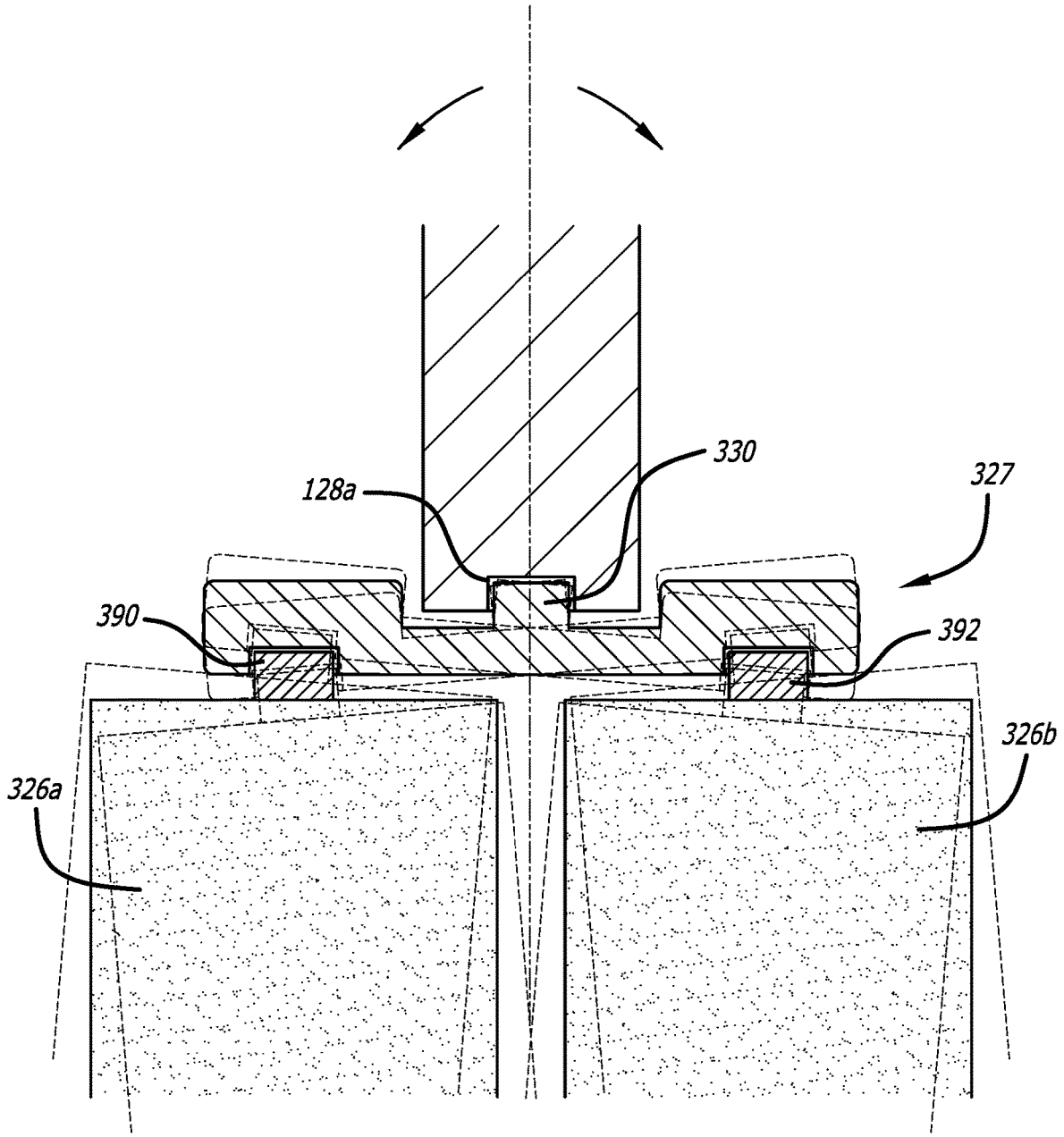
FIG. 35 is a partial front view of the dual roller mechanism of FIG. 30.

FIG. 30 is a partial side view of a dual roller mechanism in a body massaging apparatus, according to one aspect. FIG. 31 illustrates pivoting of the rollers in the dual roller mechanism in the body massaging apparatus of FIG. 30. FIG. 32 is a top plan view of a plate member the body massaging apparatus of FIG. 30 showing the rollers in the dual roller mechanism in a first position. FIG. 33 is a top plan view of the plate member of FIG. 32 showing each roller in the dual roller mechanism tilted in a second position. FIG. 34 is a partial side of the view of the dual roller mechanism of FIG. 30. FIG. 35 is a partial front view of the dual roller mechanism of FIG. 30. The following discussion refers interchangeably to FIGS. 30-35.

In FIGS. 30-35, a first massaging member having a dual roller mechanism providing for the individual rotation and tilting of the first and second rollers 326*a*, 326*b* is provided. The individual rotation and tilting of the first and second rollers 326*a*, 326*b* allows for the rollers to contour to the various different joints of the body.

As described above, the first massaging member may be secured within a medial section of the first arm 102 by an upper plate member 327 and a lower plate member. The upper plate member 327 may be rotatably secured to the first arm 302 (or the second arm) by a substantially rigid shaft 330 extending perpendicularly outward from the middle portion 327*e* of the upper plate member 327 and adapted or configured to be received within the first aperture 128*a* in the upper edge portion 102*d*4 of the inner surface 102*d* of the first arm 302. The size (diameter) of the first aperture 128*a* is larger than the substantially rigid shaft 330 such that the substantially rigid shaft 330 is able to move within the first aperture 128*a*. That is, the substantially rigid shaft 330 fits loosely in the first aperture 128*a*. Additionally, the first and second openings 336 and 338 of the upper plate member 327 are adapted to receive roller shafts 390, 392 extending outwardly from the first and second rollers 326*a*, 326*b* securing the rollers to the upper plate member 327. The size (diameter) of the first and second openings 336, 338 of the upper plate member 327 are larger than the size (diameter) of the roller shafts 390, 392 allowing the shafts 390, 392 to move within the first and second openings of the upper plate member 327. That is, the roller shafts 390, 392 fits loosely in the first and second openings.

The roller shafts 390, 392 may be two parallel rods secured by the center contact point of the upper plate member 327 and the lower plate member (not shown). The center contact point is created by the substantially rigid shaft 330. Although not shown, the lower plate member is similarly connected or secured to the first arm 302 and the first and second rollers 326*a*, 326*b* such that the roller shafts 390, 392 and a corresponding substantially rigid shaft of lower plate are able to move within the openings and aperture, respectively, of the lower plate. That is, the roller shafts 390, 392 and a substantially rigid shafts are not held statically in a fixed position.

This movement of the substantially rigid shaft 330 and the roller shafts 390, 392 in their respect receiving aperture and holes allow the first and second rollers 326*a*, 326*b* to shift not only vertically up and down (See FIG. 34) but also side to side (See FIG. 35). That is, in addition to the first and second rollers 326*a*, 326*b* rotating, the first and second rollers 326*a*, 326*b* can simultaneously tilt along multiple axis.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A body massage device, comprising:

a first arm, having a first arm upper end and a first arm lower end, the first arm lower end having a pair of elongated members, each of the elongated members comprising a first side connected to the first arm lower end and extending outward therefrom to an opposing second side, and, each of the elongated members in the pair of elongated members having a slotted guideway with corresponding discrete pairs of depressions along its length;

a second arm having a second arm upper end and a second arm lower end, the second arm lower end having a securing member adapted to be removeably received in a pair of depressions formed in the slotted guideway of each of the elongated members in the pair of elongated members, and wherein the second arm is rotatable and removeable from the slotted guideway in the first arm, where the first arm lower end includes a first elongated member of the pair of elongated members integrally connected to, and extending perpendicularly outward from a first side of the first arm, and a second elongated member of the pair of elongated members integrally connected to, and extending perpendicularly outward from, a second side of the first arm; and where the first elongated member is separated from the second elongated member forming a channel configured to receive the second arm lower end of the second arm; and wherein the second arm lower end is receivable by the channel when the second arm is in an orientation perpendicular to the first arm, and wherein the second arm is removeable from the channel when the second arm is in an orientation perpendicular to the first arm;

wherein the securing member of the second arm lower end is engageable with a pair of depressions formed in the slotted guideway of the first and the second elongated members of the first arm by aligning the securing member with a selected pair of depressions when the second arm is in an orientation perpendicular to the first arm and pivoting the second arm into a parallel orientation to the first arm for engagement of the securing member with the selected pair of depressions;

a first massaging member having a dual roller mechanism for securing a pair of moveable rollers secured within a medial section of the first arm by an upper plate member and a lower plate member, the dual roller mechanism providing for individual rotation and titling of a first roller in the pair of moveable rollers separate from a second roller the pair of moveable rollers;

a second massaging member secured within a medial section of the second arm; and a base connected to bottom surfaces of the elongated members of the first arm, the base having an upper portion integrally connected to a lower portion; and wherein the upper plate member moves in conjunction with the lower plate member allowing a user to change a tilt of the pair of moveable rollers.

2. The body massage device of claim 1, wherein the upper plate member comprises:

a first surface and a second opposing surface;
a first side portion;
a second side portion;
an intermediate portion integrally connected to the first and second side portions;
a first stop located on the upper surface of the first side portion; and
a second stop located on the upper surface of the second side portion;
a first opening extending through the first side portion and the first stop; and
a second opening extending through the second side portion and the second stop;
a rigid shaft extending perpendicularly outward from the intermediate portion into an opening in the first arm;
a first roller axis extending from the first roller in the pair of rollers movable in the first opening; and
a second roller axis extending from the second roller in the pair of rollers movable in the second opening.

3. The body massage device of claim 2,
wherein the diameter of the rigid shaft is smaller than the diameter of the opening in the first arm, which allows the rigid shaft to move within the opening; and
wherein the diameter of the first roller shaft is smaller than the diameter of the first opening, allowing the first roller shaft to move within the first opening; and
wherein the diameter of the second roller shaft is smaller than the diameter of the second opening, allowing the second roller shaft to move within the second opening.

4. The body massage device of claim 2, wherein movement of the rigid shaft and the first and second roller shafts allows the first and second roller to shift vertically up and down and to shift side to side.

5. The body massage device of claim 1, wherein the upper plate member has a rotation angle of 25 degrees in a single direction.

6. The body massage device of claim 1, wherein the upper plate member has a rotation angle of 7 degrees in a single direction.

7. The body massage device of claim 1, wherein the first arm comprises:
an outer surface;
an inner surface having a first cavity adapted to receive the first massaging member; and
an inner wall integrally connected between the outer and inner surfaces.

8. The body massage device of claim 1, wherein the second arm comprises:
an outer surface;
an inner surface having a second cavity adapted to receive the second massaging member; and
an inner wall integrally connected between the outer and inner surfaces; and
wherein the outer surface has an arcuate shape and the inner surface comprises:
an upper portion;
a lower portion; and
a medial portion integrally connected between the upper portion and the lower portion by an upper edge portion and a lower edge portion, the upper and lower edge portions extend perpendicularly outward from the medial portion forming the second cavity.

9. The apparatus of claim 8, wherein the upper portion and the lower portion are located within a first vertical plane and the medial portion is located within a second vertical plane, where the first vertical plane is different than the second vertical plane.

10. The body massage device of claim 1, wherein the first and second arms and the first and second massaging members are shaped and dimensioned to adjustably retain a human body part between the first massaging member and the second massaging member when the first arm upper end and the second upper arm end are held in close proximity to each other, whereby pressure that is applied to the human body part is variable and dynamically leveraged as the human body part is moved between the first and second arms relative thereto.

11. A body massage device, comprising:
a first arm, having a first arm upper end and a first arm lower end, the first arm lower end having a pair of elongated members, each of the elongated members comprising a first side connected to the first arm lower end and extending outward therefrom to an opposing second side, and, each of the elongated members in the pair of elongated members having a slotted guideway with corresponding discrete pairs of depressions along its length;
a second arm having a second arm upper end and a second arm lower end, the second arm lower end having a securing member adapted to be removeably received in a pair of depressions formed in the slotted guideway of each of the elongated members in the pair of elongated members, and
wherein the second arm is rotatable and removeable from the slotted guideway in the first arm, where the first arm lower end includes a first elongated member of the pair of elongated members integrally connected to, and extending perpendicularly outward from a first side of the first arm, and a second elongated member of the pair of elongated members integrally connected to, and extending perpendicularly outward from, a second side of the first arm; and where the first elongated member is separated from the second elongated member forming a channel configured to receive the second arm lower end of the second arm; and
wherein the second arm lower end is receivable by the channel when the second arm is in an orientation perpendicular to the first arm, and wherein the second arm is removeable from the channel when the second arm is in an orientation perpendicular to the first arm;
wherein the securing member of the second arm lower end is engageable with a pair of depressions formed in the slotted guideway of the first and the second elongated members of the first arm by aligning the securing member with a selected pair of depressions when the second arm is in an orientation perpendicular to the first arm and pivoting the second arm into a parallel orientation to the first arm for engagement of the securing member with the selected pair of depressions;
a first massaging member having a dual roller mechanism for securing a pair of moveable rollers secured within a medial section of the first arm by an upper plate member and a lower plate member, the dual roller mechanism providing for individual rotation and titling of a first roller in the pair of moveable rollers separate from a second roller the pair of moveable rollers, wherein the upper plate member comprises:
a first surface and a second opposing surface;
a first side portion;
a second side portion;
an intermediate portion integrally connected to the first and second side portions;
a first stop located on the upper surface of the first side portion; and a second stop located on the upper surface of the second side portion;

a first opening extending through the first side portion and the first stop; and a second opening extending through the second side portion and the second stop;

a rigid shaft extending perpendicularly outward from the intermediate portion into an opening in the first arm;

a first roller axis extending from the first roller in the pair of rollers movable in the first opening; and a second roller axis extending from the second roller in the pair of rollers movable in the second opening; and wherein the upper plate member moves in conjunction with the lower plate member allowing a user to change a tilt of the pair of moveable rollers.

12. The body massage device of claim 11, wherein the diameter of the rigid shaft is smaller than the diameter of the opening in the first arm, which allows the rigid shaft to move within the opening; and wherein the diameter of the first roller shaft is smaller than the diameter of the first opening, allowing the first roller shaft to move within the first opening; and wherein the diameter of the second roller shaft is smaller than the diameter of the second opening, allowing the second roller shaft to move within the second opening.

13. The body massage device of claim 12, wherein movement of the rigid shaft and the first and second roller shafts allows the first and second roller to shift vertically up and down and to shift side to side.

14. A body massage device, consisting of:

a first arm, having a first arm upper end and a first arm lower end, the first arm lower end having a pair of elongated members, each of the elongated members comprising a first side connected to the first arm lower end and extending outward therefrom to an opposing second side, and, each of the elongated members in the pair of elongated members having a slotted guideway with corresponding discrete pairs of depressions along its length;

a second arm having a second arm upper end and a second arm lower end, the second arm lower end having a securing member adapted to be removeably received in a pair of depressions formed in the slotted guideway of each of the elongated members in the pair of elongated members, and wherein the second arm is rotatable and removeable from the slotted guideway in the first arm, where the first arm lower end includes a first elongated member of the pair of elongated members integrally connected to, and extending perpendicularly outward from a first side of the first arm, and a second elongated member of the pair of elongated members integrally connected to, and extending perpendicularly outward from, a second side of the first arm; and where the first elongated member is separated from the second elongated member forming a channel configured to receive the second arm lower end of the second arm; and wherein the second arm lower end is receivable by the channel when the second arm is in an orientation perpendicular to the first arm, and wherein the second arm is removeable from the channel when the second arm is in an orientation perpendicular to the first arm;

wherein the securing member of the second arm lower end is engageable with a pair of depressions formed in the slotted guideway of the first and the second elongated members of the first arm by aligning the securing member with a selected pair of depressions when the second arm is in an orientation perpendicular to the first arm and pivoting the second arm into a parallel orientation to the first arm for engagement of the securing member with the selected pair of depressions;

a first massaging member having a dual roller mechanism for securing a pair of moveable rollers secured within a medial section of the first arm by an upper plate member and a lower plate member, the dual roller mechanism providing for individual rotation and titling of a first roller in the pair of moveable rollers separate from a second roller the pair of moveable rollers;

a second massaging member secured within a medial section of the second arm; and a base connected to bottom surfaces of the elongated members of the first arm, the base having an upper portion integrally connected to a lower portion; and wherein the upper plate member moves in conjunction with the lower plate member allowing a user to change a tilt of the pair of moveable rollers.

* * * * *